US012716159B2

(12) United States Patent
Jung et al.

(10) Patent No.: US 12,716,159 B2
(45) Date of Patent: Aug. 25, 2026

(54) DETERGENT SUPPLY DEVICE AND LAUNDRY TREATMENT APPARATUS HAVING THE SAME

(71) Applicant: LG ELECTRONICS INC., Seoul (KR)

(72) Inventors: Sungwoon Jung, Seoul (KR); Junghyun Park, Seoul (KR); Kunwoo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 102 days.

(21) Appl. No.: 18/751,710

(22) Filed: Jun. 24, 2024

(65) Prior Publication Data

US 2025/0101661 A1 Mar. 27, 2025

(30) Foreign Application Priority Data

Sep. 26, 2023 (KR) ..... 10-2023-0129267

(51) Int. Cl.
*D06F 39/02* (2006.01)
*D06F 39/08* (2006.01)
*D06F 23/04* (2006.01)

(52) U.S. Cl.
CPC ..... *D06F 39/022* (2013.01); *D06F 39/08* (2013.01); *D06F 39/085* (2013.01); *D06F 39/088* (2013.01); *D06F 23/04* (2013.01)

(58) Field of Classification Search
CPC ..... D06F 39/022; D06F 39/08; D06F 39/085; D06F 39/088; D06F 23/04
See application file for complete search history.

(56) References Cited

U.S. PATENT DOCUMENTS

2017/0167068 A1* 6/2017 Bao ..... B01F 25/3121
2020/0291563 A1* 9/2020 Del Pos ..... D06F 33/37
(Continued)

FOREIGN PATENT DOCUMENTS

CN 114059303 A 2/2022
CN 218812709 U 4/2023
(Continued)

OTHER PUBLICATIONS

Machine translation of KR 2023-0108068 A to Kim et al. (Year: 2023).*
(Continued)

*Primary Examiner* — Joseph L. Perrin
(74) *Attorney, Agent, or Firm* — Birch, Stewart, Kolasch & Birch, LLP

(57) ABSTRACT

Disclosed herein is a detergent supply device including a drawer including a body having a first storage portion and a second storage portion, a first discharge valve configured to discharge a detergent from the first storage portion, and a second discharge valve configured to discharge a detergent from the second storage portion, a housing including a first chamber allowing the body to be withdrawably accommodated therein, a second chamber communicating with the first chamber, and a chamber discharge portion configured to discharge a material from the first chamber, a first flow passage for movement of water along a direction orthogonal to a withdrawal direction of the body, a second flow passage branching from the first flow passage, a first pump connected to the first discharge valve when the body is inserted into the first chamber, and a second pump connected to the second discharge valve when the body is inserted.

20 Claims, 19 Drawing Sheets

(56) References Cited

U.S. PATENT DOCUMENTS

| | | | | |
|---|---|---|---|---|
| 2021/0062391 | A1* | 3/2021 | Jung | D06F 39/02 |
| 2022/0112648 | A1 | 4/2022 | Jung et al. | |
| 2024/0229332 | A1* | 7/2024 | Chun | D06F 39/022 |

FOREIGN PATENT DOCUMENTS

| | | | |
|---|---|---|---|
| JP | 2008-113977 | A | 5/2008 |
| KR | 10-2019-0044228 | A | 4/2019 |
| KR | 10-2020-0007549 | A | 1/2020 |
| KR | 10-2023-0059504 | A | 5/2023 |
| KR | 10-2023-0108068 | A | 7/2023 |

OTHER PUBLICATIONS

Machine translation of JP 2008-113977 A to Obayashi et al. (Year: 2008).*

* cited by examiner

【Fig. 1】
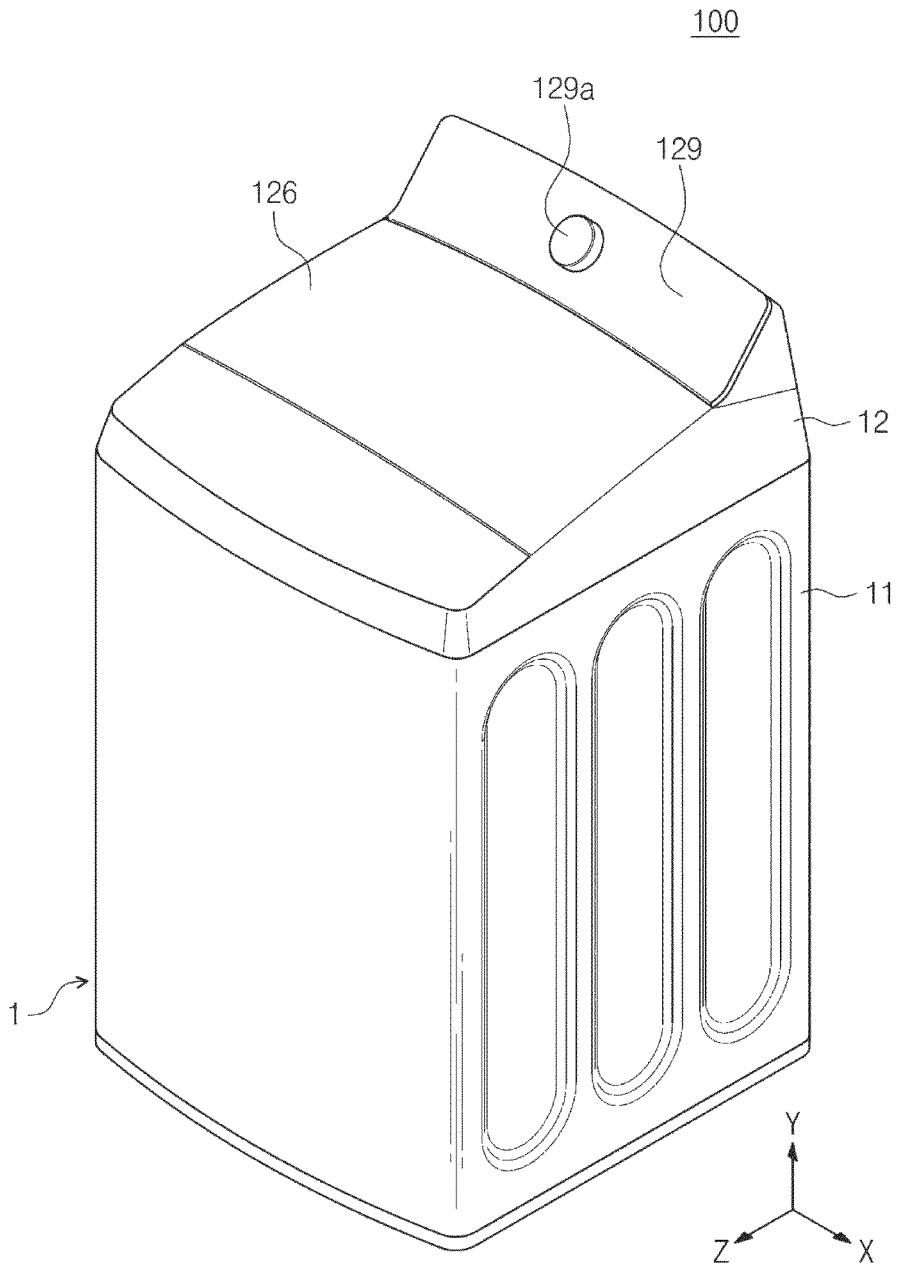

【Fig. 2】
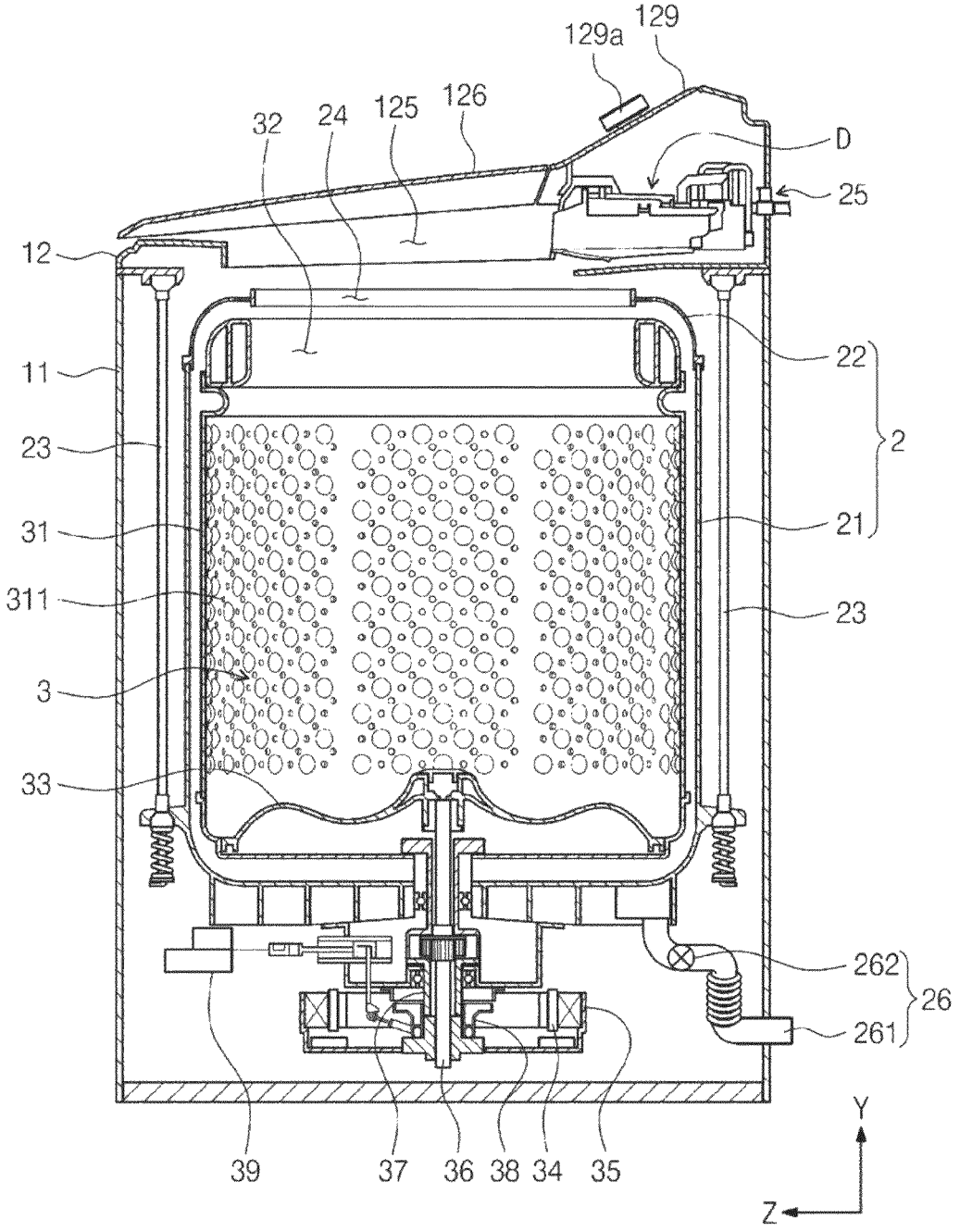

【Fig. 3】
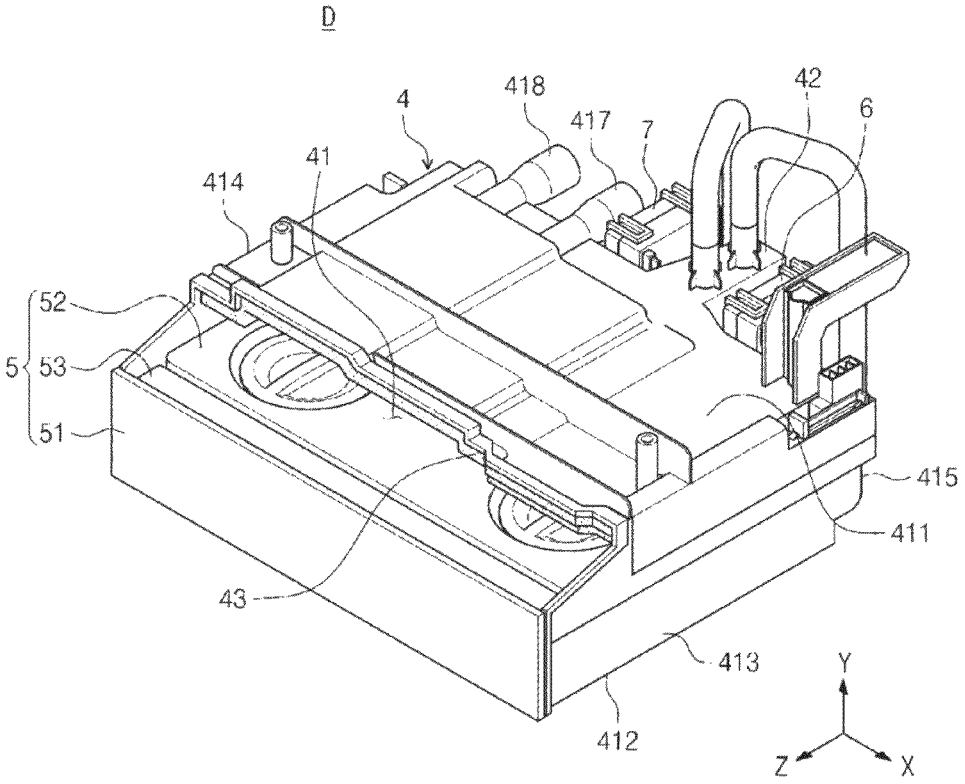

【Fig. 4】
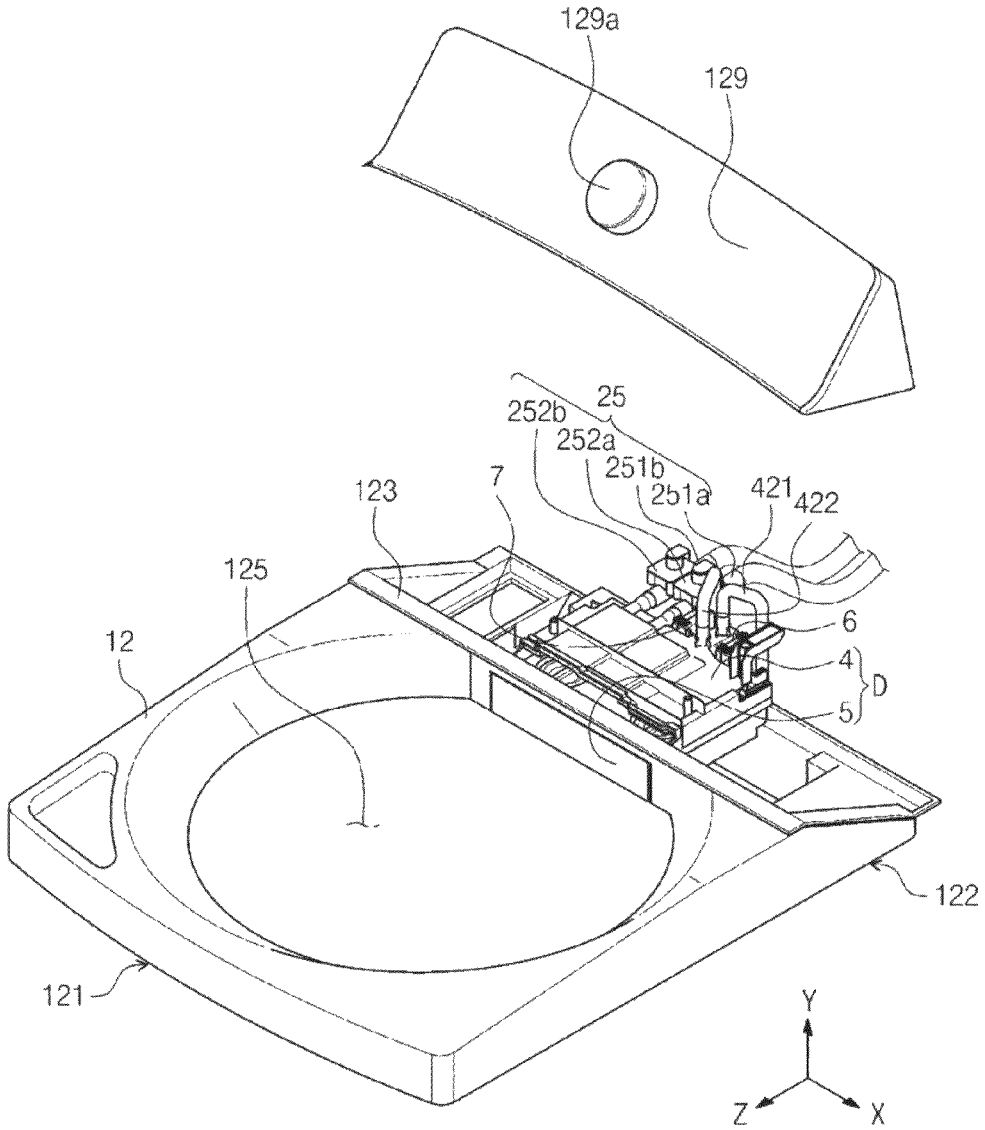

【Fig. 5】
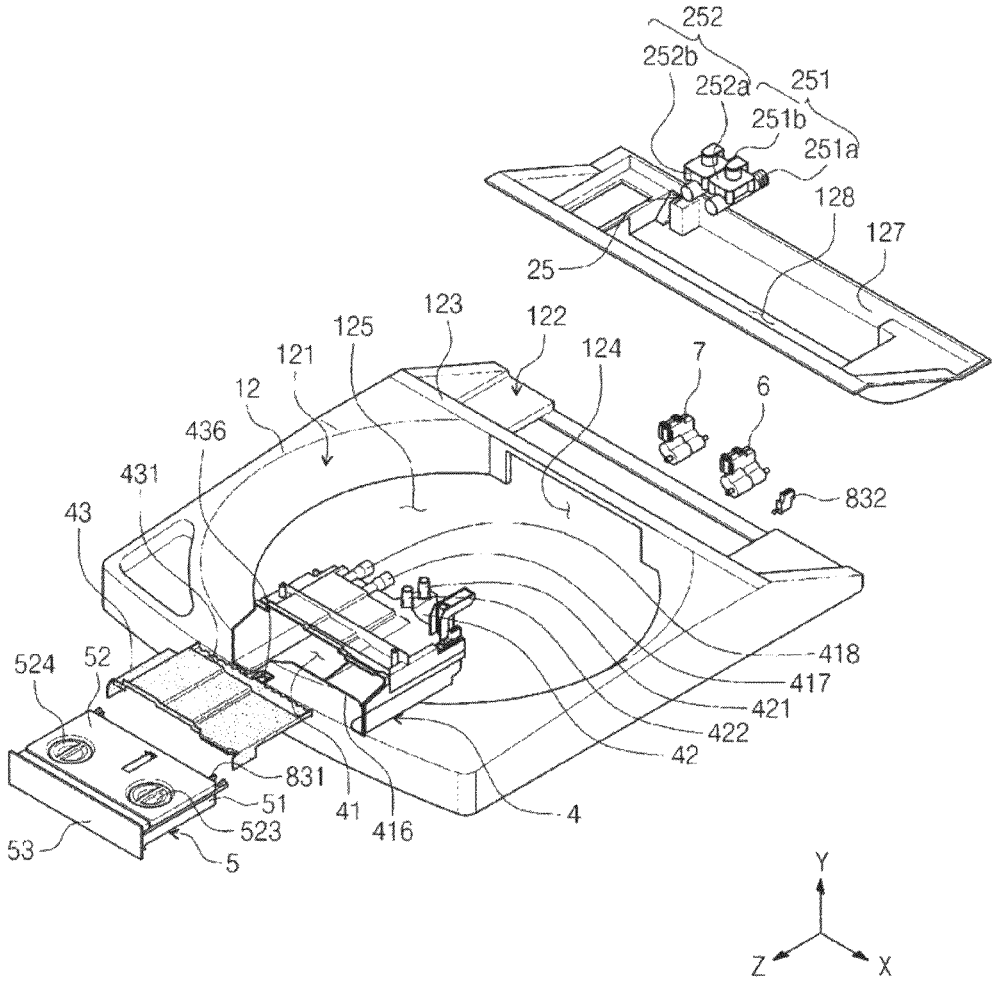

【Fig. 6】
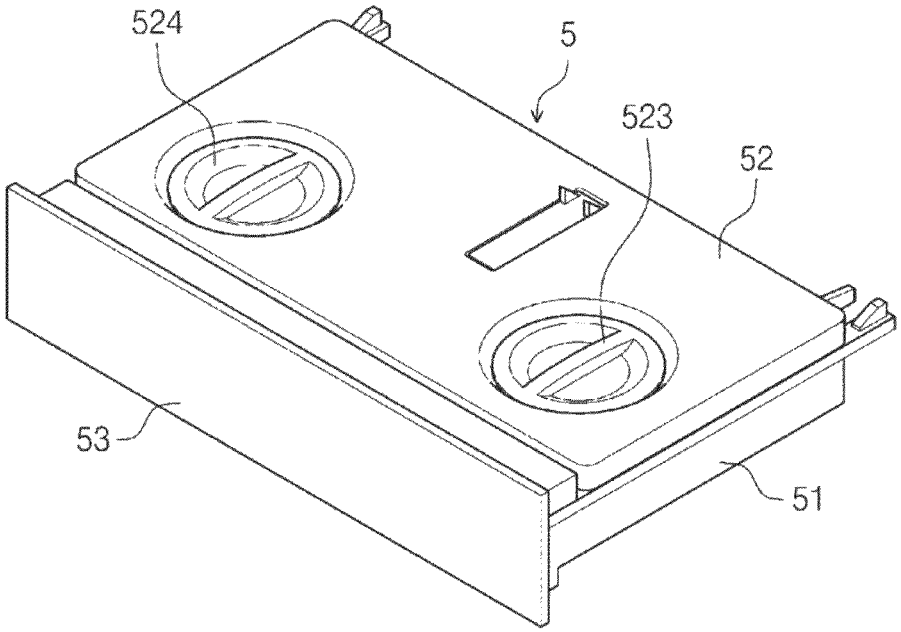

【Fig. 7】
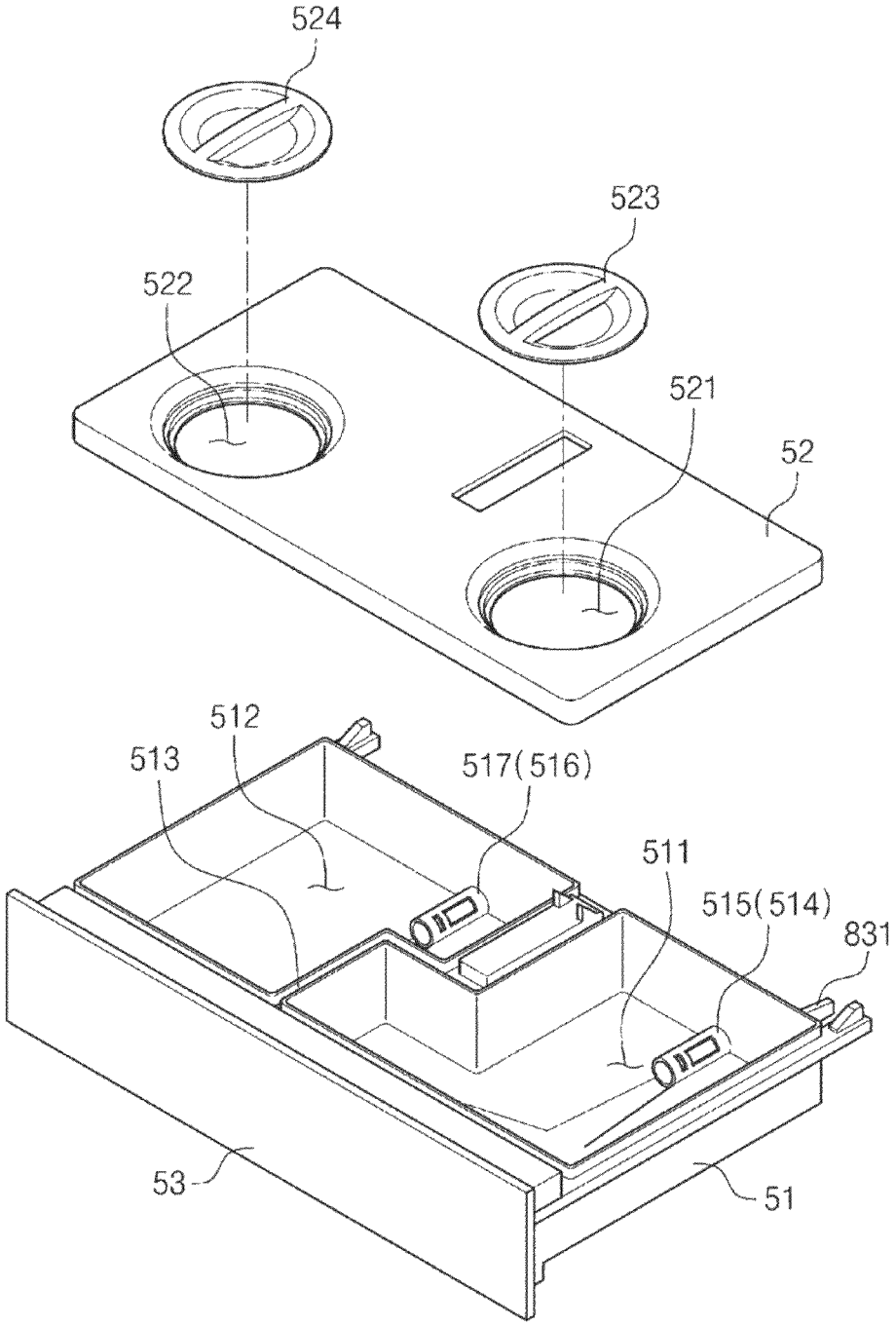

【Fig. 8】
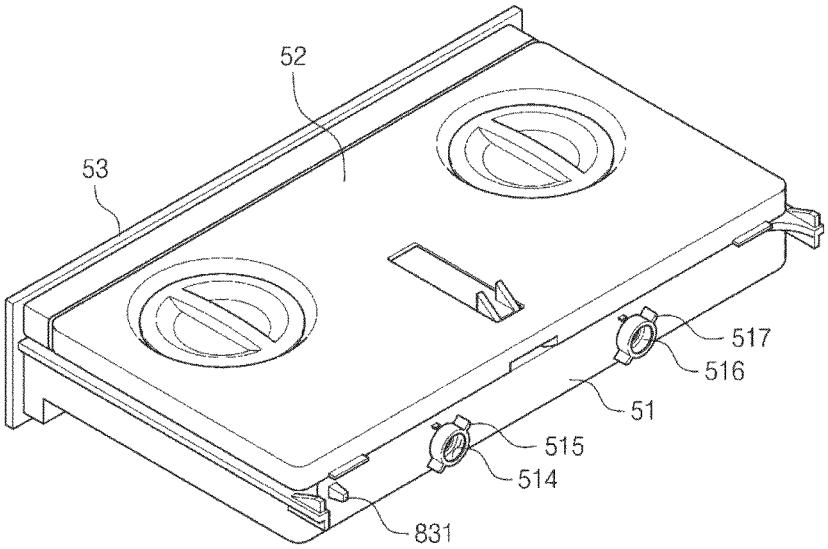

[Fig. 9]
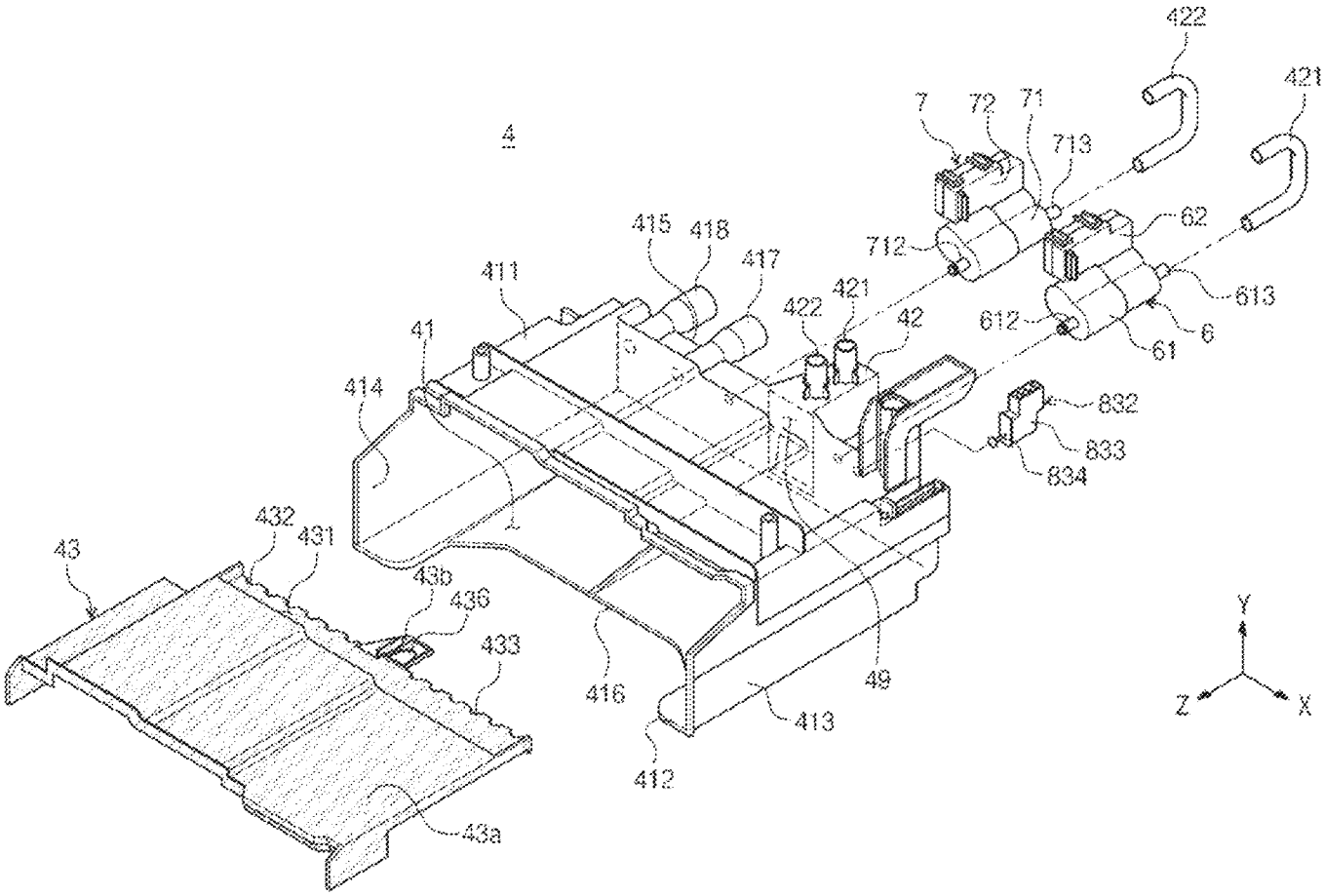

【Fig. 10】
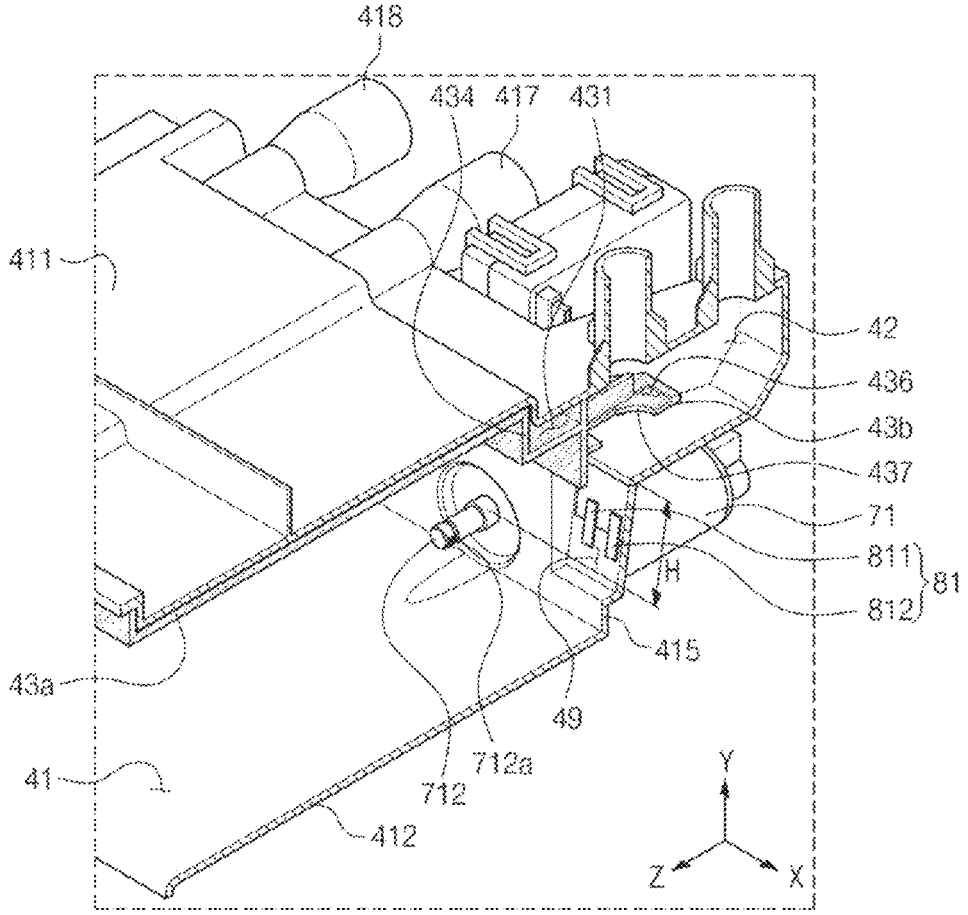

【Fig. 11】
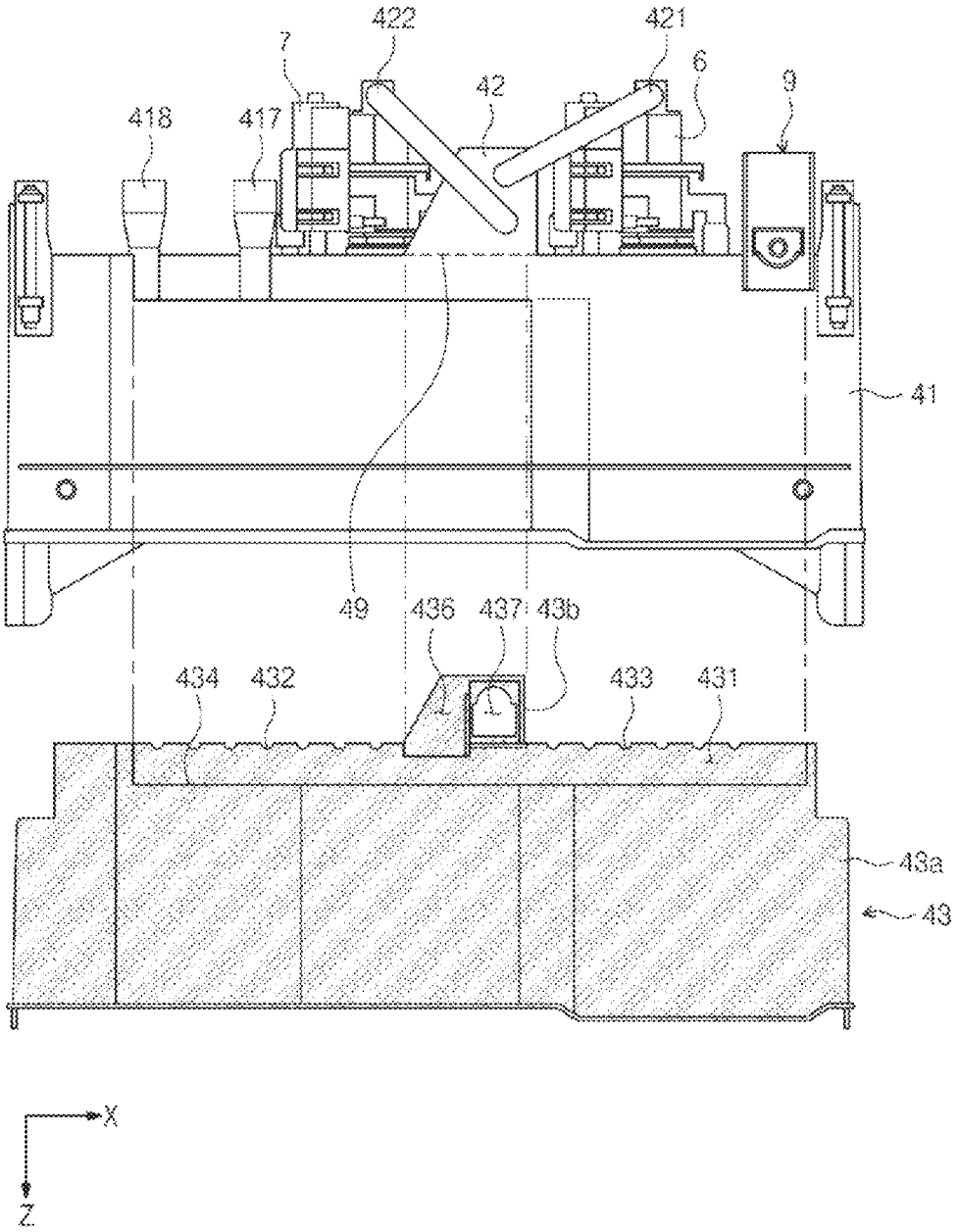

【Fig. 12】
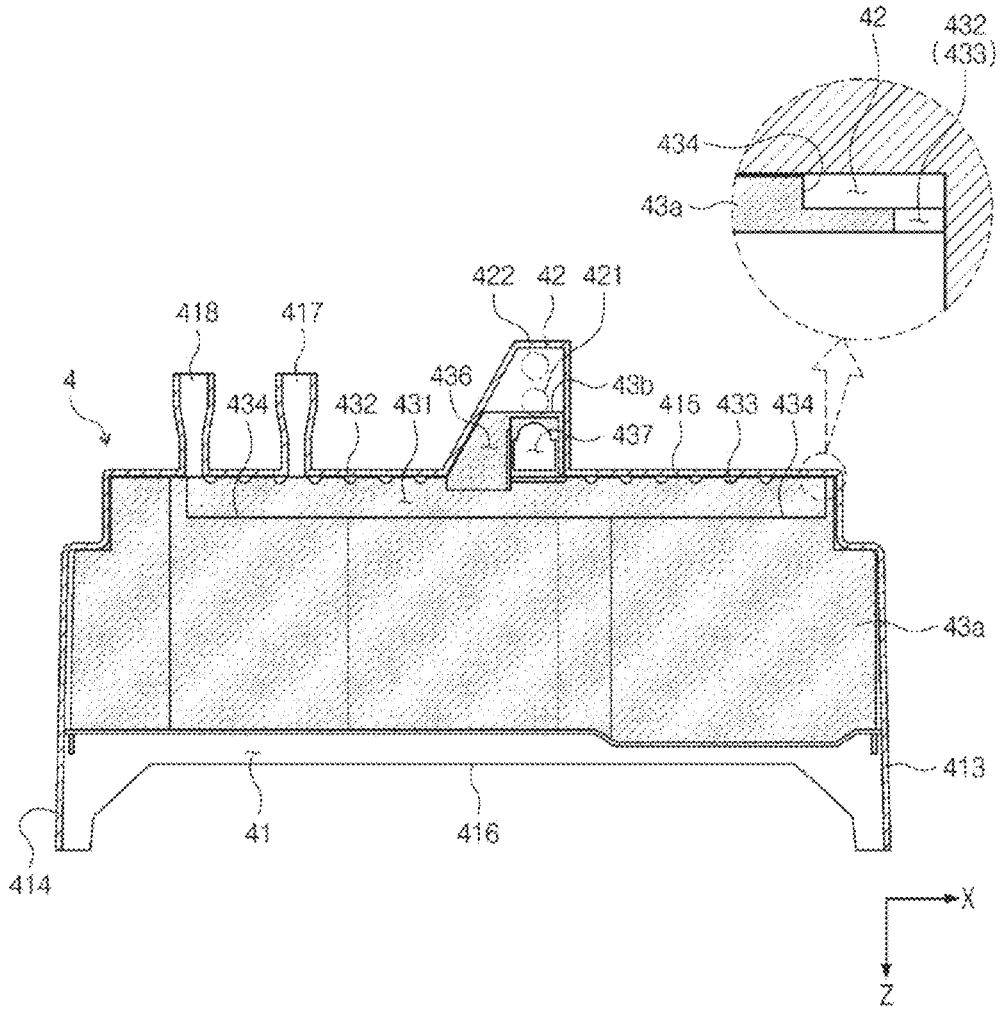

【Fig. 13】
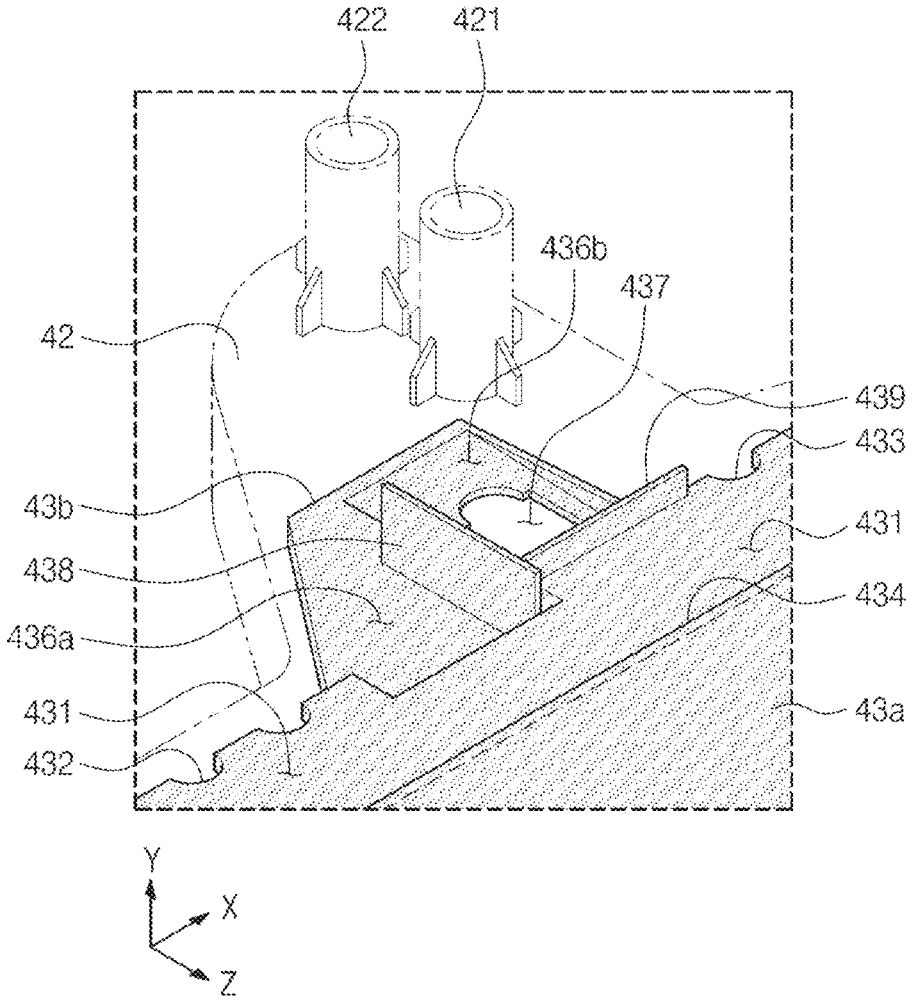

[Fig. 14]
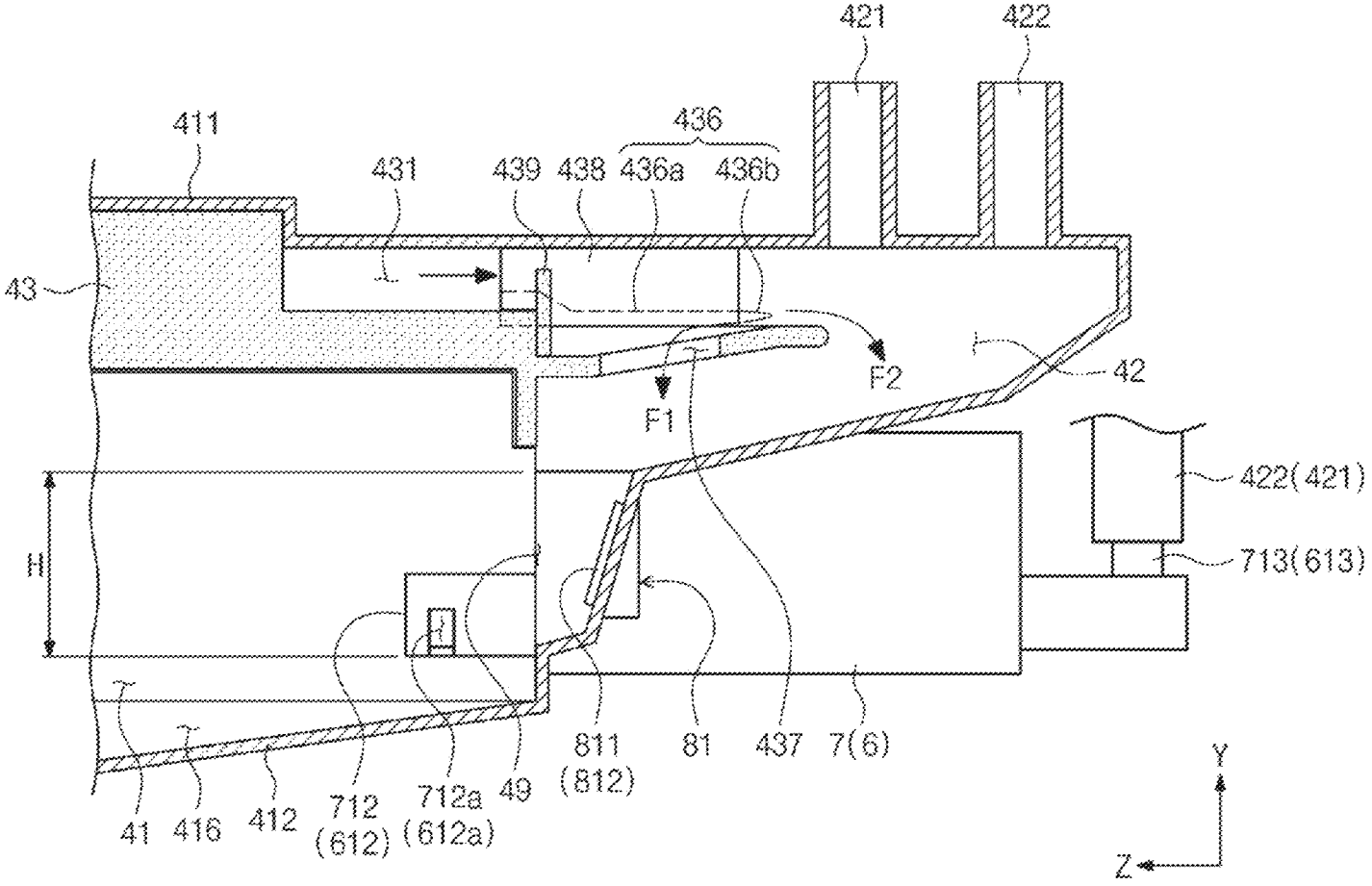

【Fig. 15】
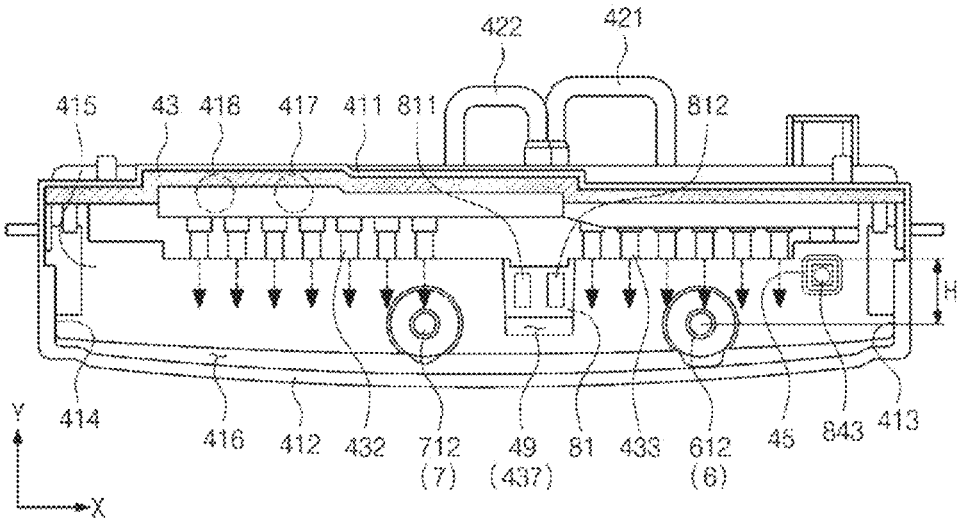
【Fig. 16】
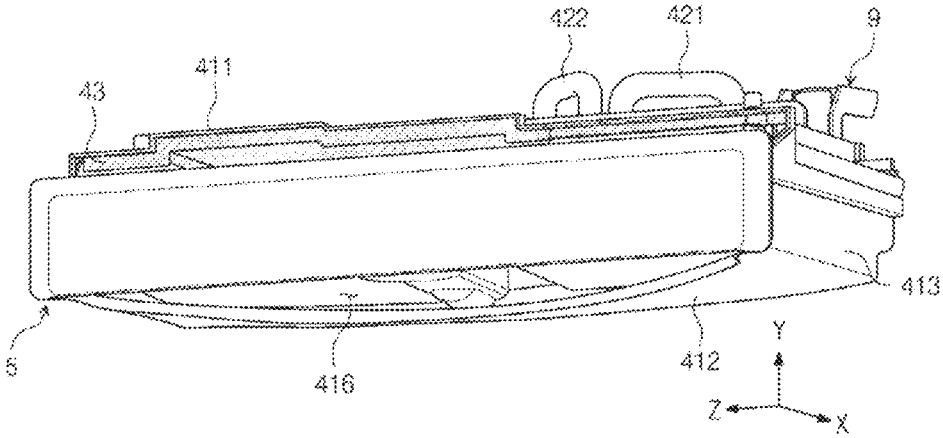

【Fig. 17】
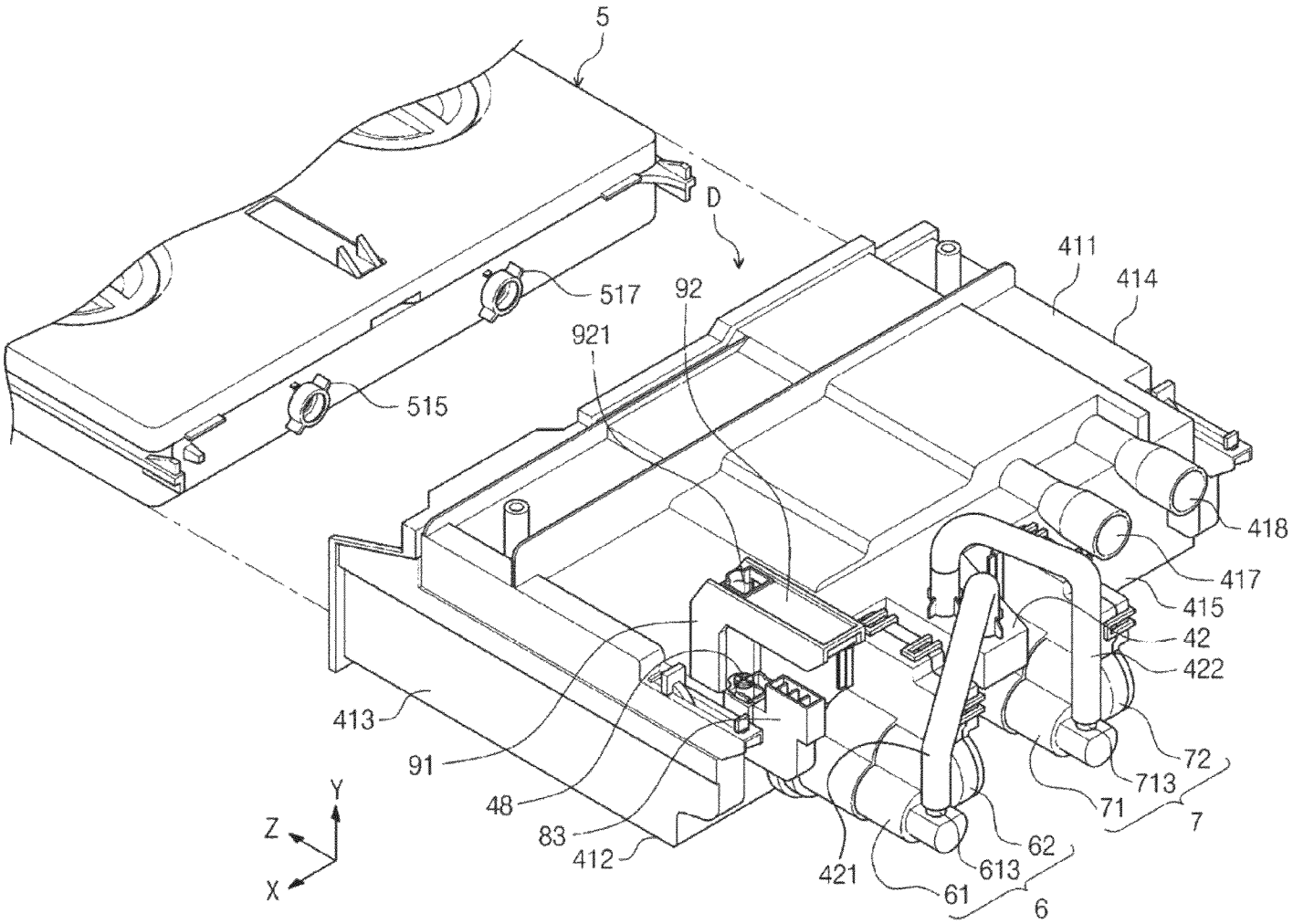

【Fig. 18】
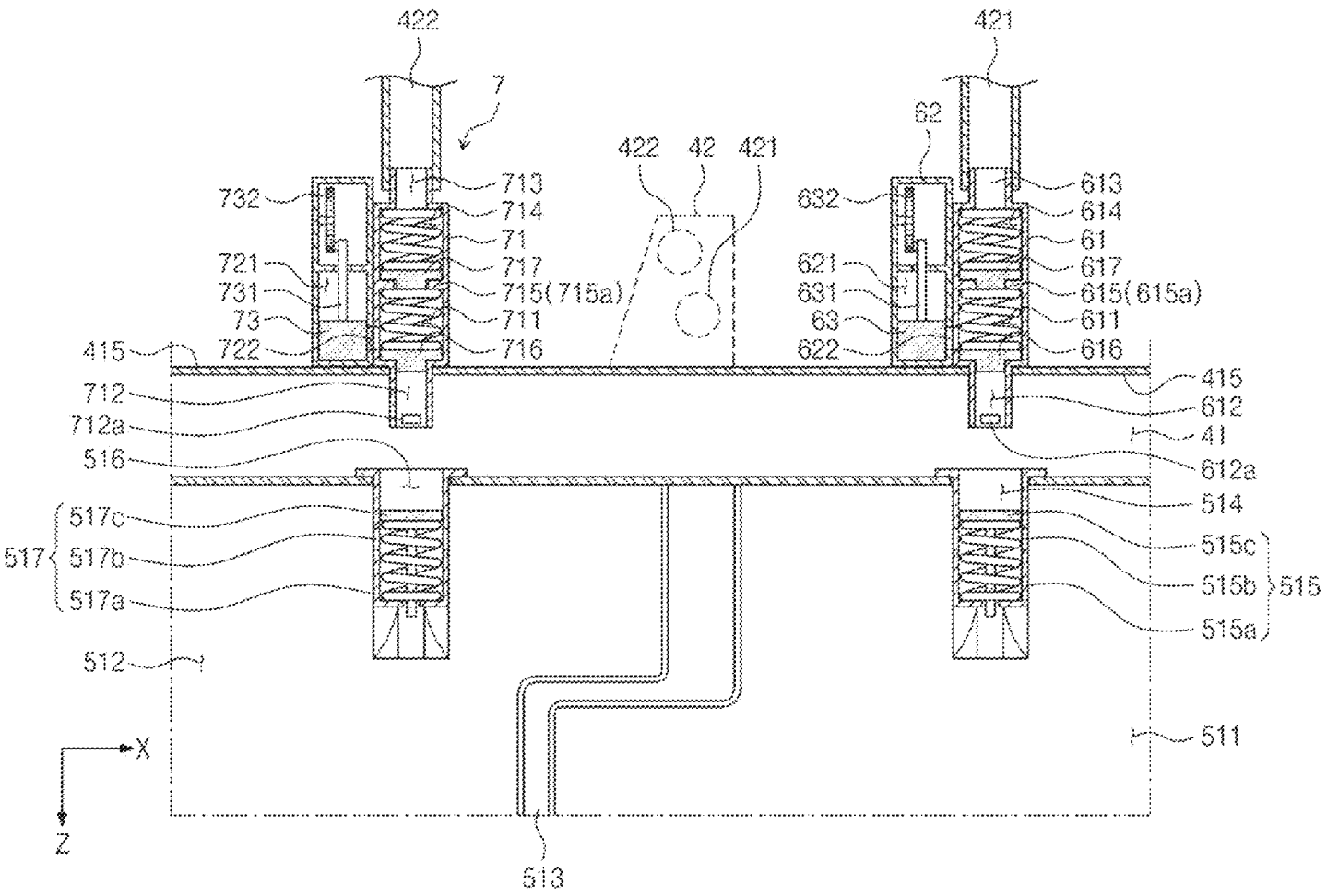

【Fig. 19】
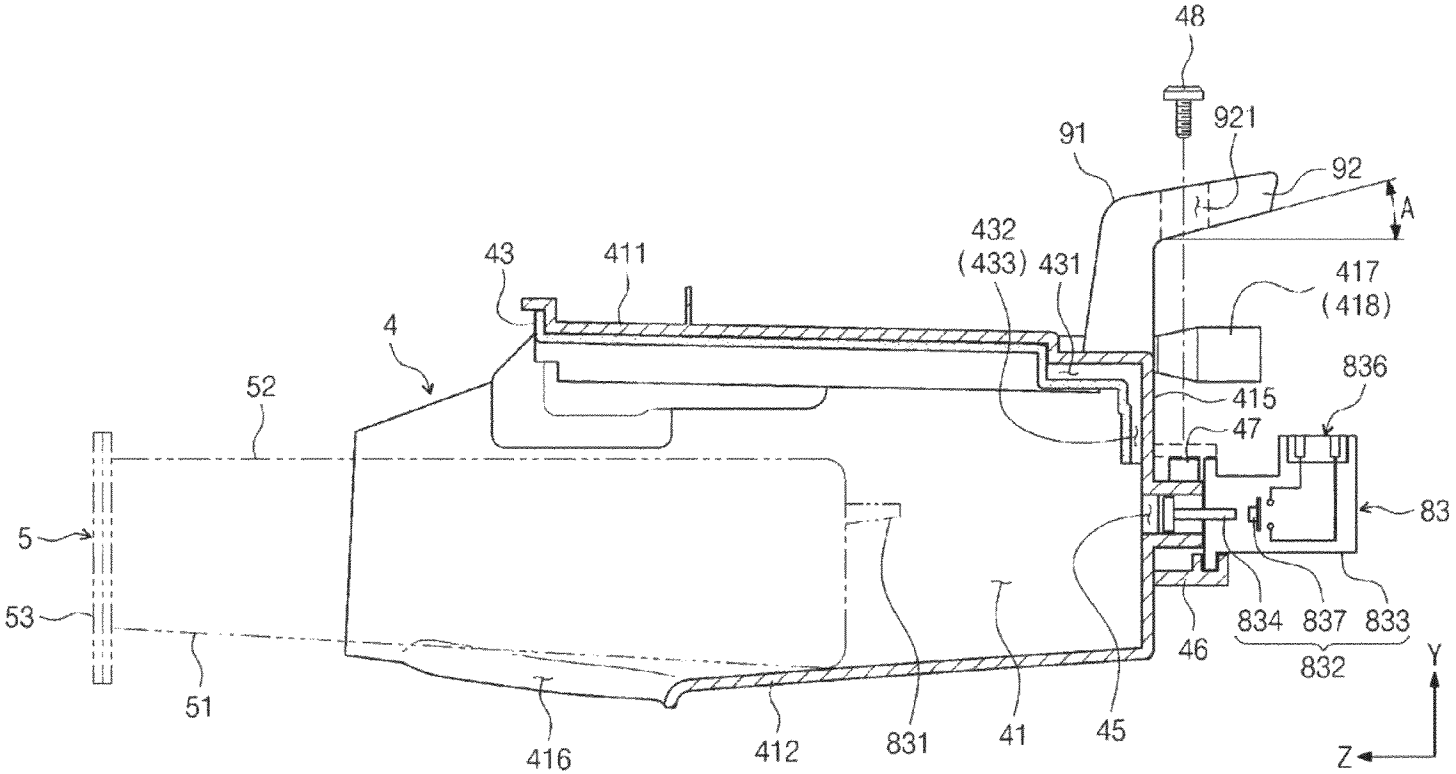

【Fig. 20】
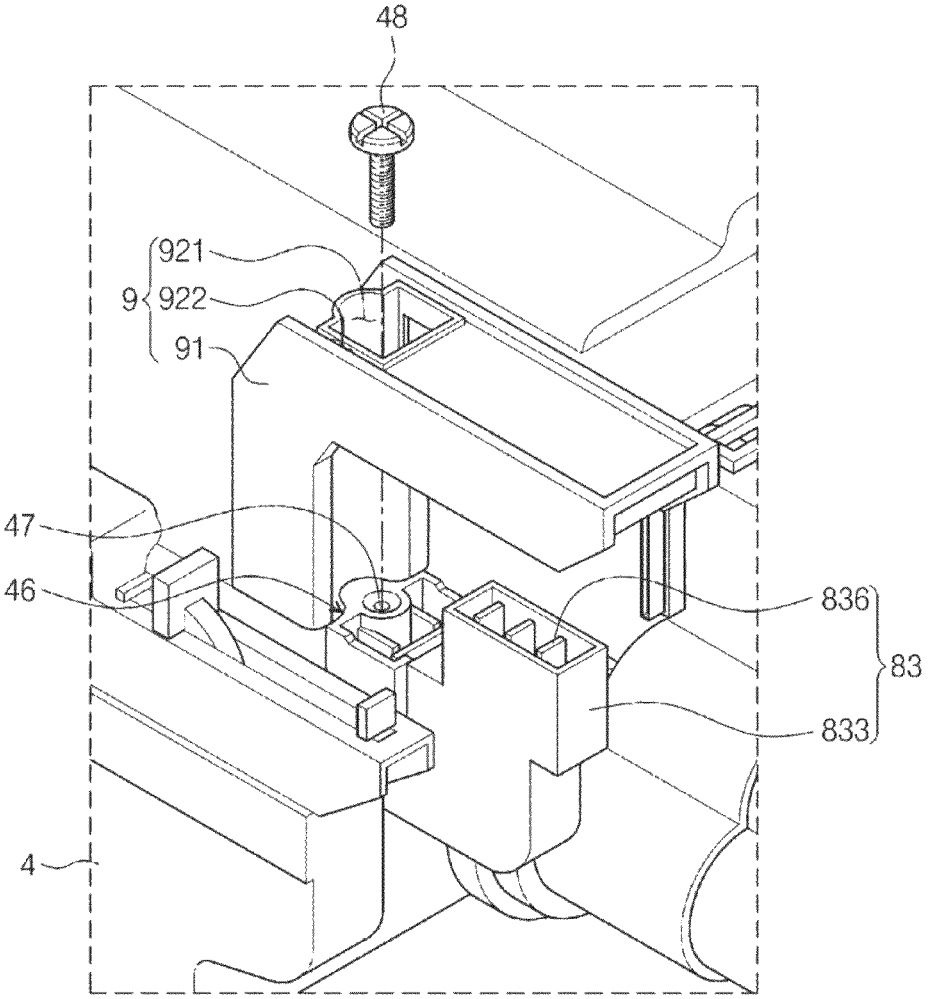

DETERGENT SUPPLY DEVICE AND LAUNDRY TREATMENT APPARATUS HAVING THE SAME

This application claims the benefit of Korean Patent Application No. 10-2023-0129267, filed on Sep. 26, 2023, which is hereby incorporated by reference as if fully set forth herein.

BACKGROUND OF THE DISCLOSURE

Technical Field

The present disclosure relates to a detergent supply device and a laundry treatment apparatus having the same.

Background

A laundry treatment apparatus for separating dirt from a laundry object (such as clothing) using water includes a tub arranged to store water, a drum rotatably disposed inside the tub to store clothing, a water supply part arranged to supply water to the tub, and a drain part arranged to drain water stored in the tub.

In order to facilitate the separation of dirt, a conventional laundry treatment apparatus is equipped with a detergent supply device configured to supply detergent to the tub. A conventional detergent supply device includes a drawer removably disposed in a cabinet of the laundry treatment apparatus, and a detergent flow passage provided in the drawer to guide detergent to the tub.

In the conventional detergent supply device described above, the water supply part is arranged to supply water to the detergent flow passage, such that upon operation of the water supply part, detergent introduced into the detergent flow passage is supplied to the tub along with water (Korean Patent Application Publication No. 10-2020-0007549). However, the detergent supply device described above has the possibility of adding more detergent than necessary, and it is inconvenient for the user to add detergent to the detergent flow passage whenever washing is required.

Among the conventional detergent supply devices, there is an automatic detergent supply device that automatically supplies detergent to the tub in performing washing (Korean Application Publication No. 10-2023-0059504). The conventional automatic detergent supply device includes a housing configured to guide water and detergent into the tub, a drawer withdrawable from the housing, a storage portion provided in the drawer to provide a space to store detergent, a pump configured to move the detergent in the storage portion into the housing when the drawer is inserted into the housing, and a water supply portion configured to supply water into the housing.

The above-mentioned automatic detergent supply device has the advantage that a relatively large amount of detergent can be stored in the storage portion. Further, since the controller can adjust the timing and operation duration of the pump, an appropriate amount of detergent can be supplied to the tub, and the inconvenience of requiring a user to introduce detergent into the detergent flow passage every time washing is required can be solved. However, the conventional automatic detergent supply device described above has the issue that detergent remains inside the housing.

SUMMARY

An object of the present disclosure is to provide a detergent supply device capable of minimizing the issue of residual detergent in a flow passage that guides the detergent to a tub, and a laundry treatment apparatus having the detergent supply device.

Another object of the present disclosure is to provide a detergent supply device that is easy to maintain and a laundry treatment apparatus having the detergent supply device.

Another object of the present disclosure is to provide a detergent supply device capable of increasing the durability of a mounting sensing part that detects whether a drawer is mounted, and a laundry treatment apparatus having the detergent supply device.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

In one aspect of the present disclosure, provided herein is a detergent supply device including a drawer including a body having a first storage portion and a second storage portion configured to store a detergent, a first discharge valve configured to discharge a detergent from the first storage portion, and a second discharge valve configured to discharge a detergent from the second storage portion, a housing including a first chamber allowing the body to be withdrawably accommodated therein, a second chamber defining a space separated from the first chamber and arranged to communicate with the first chamber through a connecting flow passage, and a chamber discharge portion configured to discharge a material inside the first chamber to the tub inlet, a first flow passage providing a path for movement of water along a direction (a width direction of the first chamber) orthogonal to a withdrawal direction of the body to supply water to the first chamber, a second flow passage branching from the first flow passage to supply water to the second chamber, a first pump configured to be connected to the first discharge valve to supply the detergent from the first storage portion to the second chamber when the body is inserted into the first chamber, and a second pump configured to be connected to the second discharge valve to supply the detergent from the second storage portion to the second chamber when the body is inserted into the first chamber.

The first pump and the second pump may be fixed to the housing so as to be positioned at points spaced apart from each other across the second chamber.

The detergent supply device may further include a first connection pipe configured to open the first discharge valve to introduce the detergent inside the first storage portion into the first pump, and a second connection pipe configured to open the second discharge valve to introduce the detergent inside the second storage portion into the second pump.

The first connection pipe and the second connection pipe may be positioned at a lower point than the second chamber.

The detergent supply device may further include a first inlet formed through the first connection pipe in a penetrating manner to introduce the detergent into the first connection pipe, the first inlet being arranged in an area of an outer circumferential surface of the first connection pipe facing a bottom surface of the first storage portion, and a second inlet formed through the second connection pipe in a penetrating manner to introduce the detergent into the second connection pipe, the second inlet being arranged in an area of an outer circumferential surface of the second connection pipe facing a bottom surface of the second storage portion.

The second flow passage may be configured to re-supply water not supplied to the second chamber to the first flow passage.

The detergent supply device may further include a plurality of first outlets configured to discharge water inside the first flow passage to the first chamber, the first outlets being positioned on one side of the connecting flow passage, and a plurality of second outlets configured to discharge the water inside the first flow passage into the first chamber, the second outlets being positioned on an opposite side of the connecting flow passage.

The detergent supply device may further include a first flow passage body fixed to the housing, the first flow passage body defining a top surface of the first chamber and providing a space to define the first flow passage, and a second flow passage body fixed to the first flow passage body, the second flow passage body dividing an inside of the second chamber into an upper space and a lower space and providing a space to define the second flow passage.

A bottom surface of the first flow passage may be positioned at a higher point than a bottom surface of the second flow passage.

The second flow passage may include a second flow passage outlet formed through the second flow passage body to connect the upper space and the lower space, a first branch flow passage provided in the second flow passage body and connected to the first flow passage, the first branch flow passage extending from the first flow passage toward the second chamber, and a second branch flow passage provided in the second flow passage body to connect the first branch flow passage and the second flow passage outlet, the second branch flow passage extending toward the first flow passage.

A bottom surface of the first flow passage may be positioned at a higher point than a bottom surface of the first branch flow passage, wherein the bottom surface of the first branch flow passage may be positioned at a higher point than the second flow passage outlet.

The second branch flow passage may be inclined down toward the second flow passage outlet.

The second branch flow passage may connect the first branch flow passage to the second chamber to allow water not supplied to the second chamber through the second flow passage outlet to be re-supplied to the first flow passage.

The detergent supply device may further include a first guide provided in the second flow passage body to define the first branch flow passage and the second branch flow passage, and a second guide positioned between the first flow passage and the second flow passage outlet to form a boundary between the first flow passage and the second branch flow passage.

The second guide may include a wall protruding from a bottom surface of the second branch flow passage to a point higher than a bottom surface of the first flow passage.

The second guide may include a wall protruding from the second branch flow passage, wherein a free end of the wall may be positioned between a bottom surface of the first flow passage and an upper end of the first guide.

In another aspect of the present disclosure, provided herein is a laundry treatment apparatus including a tub including a tub body providing a space to store water, and a tub inlet formed through one surface side of the tub body in a penetrating manner, a drum rotatably disposed in the tub to store laundry, a drawer including a body, a first storage portion and a second storage portion provided in the body to provide a space to store a detergent, a first discharge valve configured to discharge a detergent from the first storage portion, and a second discharge valve configured to discharge a detergent from the second storage portion, a housing positioned at a higher point than the tub inlet, the housing including a first chamber allowing the body to be withdrawably accommodated therein, a second chamber defining a space separated from the first chamber and arranged to communicate with the first chamber through a connecting flow passage, and a chamber discharge portion configured to discharge a material inside the first chamber to the tub inlet, a first flow passage providing a path for movement of water along a direction (a width direction of the first chamber) orthogonal to a withdrawal direction of the body to supply water to the first chamber, a second flow passage branching from the first flow passage to supply water to the second chamber, a first pump configured to be connected to the first discharge valve to supply the detergent from the first storage portion to the second chamber when the body is inserted into the first chamber, and a second pump configured to be connected to the second discharge valve to supply the detergent from the second storage portion to the second chamber when the body is inserted into the first chamber, wherein the first pump and the second pump may be fixed to the housing so as to be positioned at points spaced apart from each other across the second chamber.

The first pump may include a first pump case fixed to the housing, a first inflow chamber and a first discharge chamber provided within the first pump case, the first inflow chamber and the first discharge chamber being separated by a first chamber partition, a chamber communication hole formed through the first chamber partition to connect the first inflow chamber and the first discharge chamber, a first connection pipe arranged through the housing to have one end connected to the first inflow chamber and an opposite end disposed in the first chamber, the first connection pipe opening the first discharge valve when the body is inserted into the first chamber, a first discharge pipe arranged to discharge the detergent inside the first discharge chamber into the second chamber, a first piston chamber connected to the first inflow chamber through a first case communication hole, a first piston disposed to reciprocate in the first piston chamber, a first inflow chamber valve disposed in the first inflow chamber to open and close the first connection pipe, and a first discharge chamber valve disposed in the first discharge chamber to open and close the chamber communication hole.

The second pump may include a second pump case fixed to the housing, a second inflow chamber and a second discharge chamber provided within the second pump case, the second inflow chamber and the second discharge chamber being separated by a second chamber partition, a chamber communication hole formed through the second chamber partition to connect the second inflow chamber and the second discharge chamber, a second connection pipe arranged through the housing to have one end connected to the second inflow chamber and an opposite end disposed in the second chamber, the second connection pipe opening the second discharge valve when the body is inserted into the second chamber, a second discharge pipe arranged to discharge the detergent inside the second discharge chamber into the second chamber, a second piston chamber connected to the second inflow chamber through a second case communication hole, a second piston disposed to reciprocate in the second piston chamber, a second inflow chamber valve disposed in the second inflow chamber to open and close the second connection pipe, and a second discharge chamber valve disposed in the second discharge chamber to open and close the chamber communication hole.

The laundry treatment apparatus may further include a first connection pipe configured to open the first discharge valve to introduce the detergent inside the first storage portion into the first pump, and a second connection pipe configured to open the second discharge valve to introduce the detergent inside the second storage portion into the second pump.

The first connection pipe and the second connection pipe may be disposed at a lower point than the second chamber.

The laundry treatment apparatus may further include a first inlet formed through the first connection pipe in a penetrating manner to introduce the detergent into the first connection pipe, the first inlet being provided in an area of an outer circumferential surface of the first connection pipe facing a bottom surface of the first storage portion, and a second inlet formed through the second connection pipe in a penetrating manner to introduce the detergent into the second connection pipe, the second inlet being provided in an area of an outer circumferential surface of the second connection pipe facing a bottom surface of the second storage portion.

The laundry treatment apparatus may further include a first flow passage body fixed to the housing to define a top surface of the first chamber, the first flow passage body providing a space to define the first flow passage, and a second flow passage body fixed to the first flow passage body to divide an inside of the second chamber into an upper space and a lower space, the second flow passage providing a space to define the second flow passage.

It is to be understood that both the foregoing general description and the following detailed description of the present disclosure are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the present disclosure and together with the description serve to explain the principle of the present disclosure. In the drawings:

FIGS. 1 and 2 illustrate an example of a laundry treatment apparatus;

FIG. 3 illustrates an example of a detergent supply device;

FIGS. 4 and 5 illustrate the detergent supply device and an example of a water supply part;

FIGS. 6, 7, and 8 illustrate an example of a drawer provided in the detergent supply device;

FIGS. 9 and 10 illustrate an example of a housing provided in the detergent supply device;

FIG. 11 illustrates an example of a flow passage forming part provided in the detergent supply device;

FIGS. 12, 13, 14, and 15 illustrate an example of a first flow passage and a second flow passage provided in the detergent supply device;

FIG. 16 illustrates an example of a chamber discharge port provided in the housing;

FIGS. 17 and 18 illustrate an example of a first pump and a second pump; and FIGS. 19 and 20 illustrate an example of a mounting sensing part and a sensor cover.

DETAILED DESCRIPTION

Hereinafter, a preferred embodiment of the present disclosure will be described with reference to the accompanying drawings. Unless otherwise defined, all terms used herein shall have the same meaning as the ordinary meaning of such terms as understood by one of ordinary skill in the art to which the present disclosure pertains. If any term used herein conflicts with the ordinary meaning of such term, the definition used herein shall govern.

As shown in FIGS. 1 and 2, a laundry treatment apparatus 100 may include a cabinet 1, a tub 2 disposed inside the cabinet to store water, and a drum 3 rotatably disposed inside the tub to store laundry objects (such as clothing).

As shown in FIG. 1, the cabinet 1 may include a cabinet body 11 providing a space in which the tub 2 is accommodated, and a cabinet cover 12 fixed to the cabinet body 11 and defining a top surface of the laundry treatment apparatus.

The cabinet cover 12 may be provided with a control panel 129. The control panel 129 may include an input unit 129*a* configured to receive a control instruction from a user, and a display (not shown) configured to display information (a control instruction selectable by the user or information related to the control instruction selected by the user).

As shown in FIG. 2, the cabinet cover 12 is provided with an inlet 125 through which laundry is supplied into the drum 3. The inlet 125 is openable and closable by a door 126 rotatably fixed to the cabinet cover 12.

The tub 2 may be formed in various shapes as long as it is capable of storing water. FIG. 2 shows an example of the tub 2 which is formed in a hollow cylindrical shape.

The tub 2 of FIG. 2 may include a tub body 21 having a cylindrical shape. The tub body 21 is fixed to the cabinet 1 by a tub support 23. The tub support 23 may include one end fixed to the cabinet cover 12 or the cabinet body 11, and an opposite end provided with a bar fixed to a circumferential surface of the tub body 21.

The tub cover 22 is fixed to the top surface of the tub body 21. The tub cover 22 may be provided with a tub inlet 24 for communicating the inside of the tub body 21 with the outside. The tub inlet 24 may be positioned under the inlet 125.

The tub 2 is supplied with water through a water supply part 25, and water stored in the tub is discharged from the cabinet 1 through a drainage part 26.

The drainage part 26 may include a drain pipe 261 arranged to guide water inside the tub body 21 to the outside of the cabinet, and a drain valve 262 arranged to control the opening and closing of the drain pipe 261.

The drum 3 may include a drum body 31 having a hollow cylindrical shape, positioned inside the tub body 21 as a means providing a space in which laundry are stored.

The top surface of the drum body 31 may be provided with a drum inlet 32 arranged to be positioned under the tub inlet 24. Thus, a user may put laundry into the drum body 31 through the inlet 125, the tub inlet 24 and the drum inlet 32. A circumferential surface and a bottom surface of the drum body 31 may be provided with drum through-holes 311 allowing the tub body 21 to communicate with the inner space of the drum body 31 therethrough.

The bottom surface of the drum body 31 may further be provided with an agitator 33 rotatably disposed inside the drum body to form a water current and/or agitate the laundry.

The drum body 31 and the agitator 33 may be rotated by a drum drive part. The drum drive part may include a stator 34 fixed to the bottom surface of the tub body 21 to form a rotating magnetic field, a rotor 35 rotated by the rotating magnetic field, a drum shaft 37 extending through the tub body 21 and fixed to the drum body 31, and a agitation shaft 36 extending through the drum shaft 37 to connect the rotor 35 and the agitator 33.

To control the coupling between the drum shaft 37 and the rotor 35, the drum drive part may include a coupler 38 and an actuator 39. The actuator 39 is a means to control the position of the coupler 38, and the actuator 39 may cause the coupler 38 to reciprocate between a first point and a second point. In this case, the first point may be set as a point at which the coupler 38 connects the drum shaft 37 to the rotor 35, and the second point may be set as a point at which the coupler 38 disconnects the drum shaft 37 from the rotor 35.

The laundry treatment apparatus 100 may have a detergent supply device (detergent supplier) D arranged to supply detergent to the tub body 21. The detergent supply device D may be arranged to move detergent to the tub body 21 using water supplied from the water supply part 25 (the water supply part may supply water to the tub body through a flow passage provided inside the detergent supply device).

As shown in FIG. 3, the detergent supply device D may include a housing 4 arranged to guide water supplied from the water supply part 25 to the tub body 21, a drawer 5 providing a space for storing detergent and withdrawable from the housing 4, and pumps 6 and 7 configured to move the detergent stored in the drawer 5 into the housing 4.

As shown in FIG. 4, the detergent supply device D may be secured to the cabinet cover 12. As shown in FIG. 5, the cabinet cover 12 may be provided with a first area 121 and a second area (rear space) 122, which are divided by a partition 123. The first area 121 is a front space of the cabinet cover 12, wherein the inlet 125 may be provided in the first area 121. The second area 122 is a rear space of the cabinet cover 12, wherein the detergent supply device D and the water supply part 25 may be provided in the second area 122.

The partition 123 may be provided with a partition through-hole 124. The partition through-hole 124 may be formed in the partition 123 as a through-hole such that the inlet 125 is connected to the second area 122.

The laundry treatment apparatus 100 may include a support body 127 that is fixed to the cabinet cover 12 to support the housing 4 of the detergent supply device and is positioned in the second area 122. In this case, the water supply part 25 may include a water supply pipe 251 and a valve 252 arranged to control the opening and closing of the water supply pipe in response to a control signal from a controller (not shown).

The valve 252 may include a first valve 252*a* and a second valve 252*b* fixed to the support body 127, and the water supply pipe 251 may include a first water supply pipe 251*a* connecting the first valve 252*a* to a first water supply source (not shown), and a second water supply pipe 251*b* connecting the second valve 252*b* to a second water supply source (not shown).

The first water supply pipe 251*a* and the second water supply pipe 251*b* may be arranged to supply water of the same temperature to the detergent supply device D, or may be arranged to supply water of different temperatures to the detergent supply device D. In the former case, the first water source and the second water source may be the same water source. However, in the latter case, the first water source may be configured to supply cold water and the second water source may be configured to supply hot water.

The support body 127 may be provided with a support body through-hole 128. The support body through-hole 128 may be connected to the partition through-hole 124 to guide the housing 4 to the top surface of the support body 127. Thus, the housing 4 may be seated on the support body 127 by being inserted into the partition through-hole 124 and into the support body through-hole 128 (and may be positioned in a second area).

The housing 4 may include a first chamber 41 providing a space to accommodate the drawer 5, and a second chamber 42 configured to receive detergent from the pumps 6 and 7.

The second chamber 42 may be configured to provide a space separated from the first chamber 41. FIG. 5 illustrates an example in which the second chamber 42 is positioned outside the first chamber 41. In other words, the second chamber 42 may be configured as a space that protrudes from the rear surface of the first chamber 41 towards the direction in which the drawer 5 is inserted (the direction of −Z-axis) but has a smaller volume than the first chamber. The second chamber 42 is connected to the first chamber 41 by a connecting flow passage 49.

By disposing the second chamber 42 outside the first chamber 41, the volume of the drawer 5 may be increased (and the amount of detergent that the drawer can store may be increased). By setting the volume of the second chamber 42 to be small, the possibility of detergent supplied from the pumps 6 and 7 remaining inside the second chamber 42 may be minimized. The small volume of space inside the housing 4 in which detergent may remain increases the possibility of discharging all the detergent inside the second chamber 42 into the first chamber 41 through the water supply part 25.

The housing 4 is provided with a flow passage defining part 43. The flow passage defining part 43 is a means to define flow passages 431 and 436 arranged to guide water supplied from the water supply part 25 into the first chamber 41 and the second chamber 42.

To supply water to the flow passages 431 and 436, the housing 4 may be provided with a first water supply port 417 and a second water supply port 418. The first water supply port 417 may be connected to the first valve 252*a*, and the second water supply port 418 may be connected to the second valve 252*b*. FIG. 5 illustrates an example of the water supply ports 417 and 418, wherein the first water supply port 417 is connected to the first valve 252*a* and the second water supply port 418 is connected to the second valve 252*b* when the housing 4 is mounted on the support body 127.

The drawer 5 may provide a space where detergent is stored, and may be withdrawable from the first chamber 41.

As shown in FIG. 6, the drawer 5 may include a body (drawer body) 51 that provides a space in which detergent is stored and is inserted into the first chamber 41, a cover (drawer cover) 52 that is fixed to the body and defines a top surface of the drawer, and a panel (drawer panel) 53 that is fixed to a front surface of the body 51 and exposed to the outside of the first chamber 41.

The body 51 may include a storage portion providing a space to store detergent, an outlet disposed to discharge detergent from the storage portion to the outside of the body 51, and an discharge valve configured to control opening and closing of the outlet.

FIG. 7 illustrates an example case where the storage portion is provided with two storage spaces separated by a body partition 513, wherein the storage portion may include a first storage portion 511 and a second storage portion 512 separated from each other by the body partition 513.

In this case, the outlet may include a first storage portion outlet 514 provided in the first storage portion 511 and a second storage portion outlet 516 provided in the second storage portion 512, and the discharge valve may include a first discharge valve 515 configured to control the opening and closing of the first storage portion outlet 514 and a second discharge valve 517 configured to control the opening and closing of the second storage portion outlet 516.

The cover 52 may be provided with a first detergent inlet 521 allowing detergent to be introduced into the first storage portion 511 therethrough and a second detergent inlet 522 allowing detergent to be introduced into the second storage portion 512 therethrough. The first detergent inlet 521 is openable and closable by a first lid 523, and the second detergent inlet 522 is openable and closable by a second lid 524.

The first discharge valve 515 and the second discharge valve 517 are valves (such as check valves) that allow fluid to be discharged from the respective storage portions 511 and 512 but prevent external fluid from entering the storage portions 511 and 512.

The first discharge valve 515 and the second discharge valve 517 may be configured to open the respective storage portion outlets 514 and 516 when the body 51 is inserted into the first chamber 41 and to close the storage portion outlets 514 and 516 when the body 51 is withdrawn from the first chamber 41.

FIG. 8 illustrates an example case where the first discharge valve 515 and the second discharge valve 517 are disposed on the rear surface of the body 51. In this case, the first discharge valve 515 and the second discharge valve 517 will control the opening and closing of the storage portion outlets 514 and 516 by the pumps 6 and 7, respectively.

The panel 53 is positioned on the outside of the housing 4 even when the body 51 is inserted into the first chamber 41. Thus, the panel 53 may also serve as a handle used for a user to withdraw the body 51 from the housing 4. FIGS. 4 and 5 illustrate an example case where the panel 53 has a shape capable of closing the partition through-hole 124 provided in the cabinet cover 12.

As shown in FIG. 9, the housing 4 may include a first chamber 41, a second chamber 42, and a flow passage defining part 43.

The first chamber 41 may be defined by a lower surface 412 supported on the support body 127, first and second side surfaces 413 and 414 provided on both side edges of the lower surface, a top surface 411 positioned over the lower surface by the two side surfaces 413 and 414, and a rear surface 415.

The front face of the first chamber 41 may be an open face that provides a space for the body 51 of the drawer 5 to enter and exit, and the lower surface 412 may be provided with a chamber discharge portion 416 through which fluid inside the first chamber 41 is discharged to the outside of the first chamber (such as the tub inlet). To facilitate the discharge of the fluid inside the first chamber 41 to the outside (to minimize the possibility that the fluid remains in the chamber), the lower surface 412 may be provided with a slope inclined down toward the chamber discharge portion 416.

The first water supply port 417 and the second water supply port 418 may be provided on the rear surface 415, and the second chamber 42 may be provided as a space protruding from the rear surface 415 toward the direction in which the drawer 5 is inserted (−Z-axis direction).

The second chamber 42 is connected to the first chamber 41 through a connection flow passage 49 arranged through the rear surface 415 in a penetrating manner. The bottom surface of the second chamber 42 positioned at a higher point than the bottom surface of the first chamber 41 to allow the fluid inside the second chamber 42 to drain naturally. The second chamber 42 is connected to the pumps 6 and 7 by a first supply pipe 421 and a second supply pipe 422.

The flow passage defining part 43 may include a first flow passage body 43*a* defining a flow passage (first flow passage) 431 inside the first chamber 41, and a second flow passage body 43*b* defining a flow passage (second flow passage) 436 inside the second chamber 42.

The first flow passage body 43*a* may include a board fixed inside the first chamber 41, and the second flow passage body 43*b* may include a board protruding from an edge of the first flow passage body 43*a* toward the inside of the second chamber 42.

The first flow passage body 43*a* may be fixed to the top surface 411 to define an inner upper surface of the first chamber 41, and the second flow passage body 43*b* may be positioned between the bottom surface and the top surface of the second chamber 42 to divide the inside of the second chamber into an upper space and a lower space.

The edges of the second flow passage body 43*b* may be arranged to contact both inner side surfaces of the second chamber 42. In this case, the upper space and the lower space may be completely separated from each other.

Alternatively, as shown in FIG. 10, at least one of the sides constituting the edges of the second flow passage body 43*b* may be arranged not to contact the inner side surfaces of the second chamber 42. In this case, the upper space and the lower space will be interconnected spaces.

The first flow passage 431 provides a path along which water moves along the width direction (x-axis direction) of the first chamber 41. The first flow passage 431 may be a groove formed by recessing the top surface of the first flow passage body 43*a* in a direction (−Y-axis direction) away from the top surface 411 of the first chamber. In this case, a step 434 may be formed in the first flow passage body 43*a*. Thus, the bottom surface of the first flow passage 431 may be positioned at a lower point than the top surface of the first flow passage defining part 43*a*.

As shown in FIG. 11, the water inside the first flow passage 431 is discharged to the first chamber 41 through the first outlet 432 and the second outlet 433. The first outlet 432 may include a plurality of holes disposed on the left side of the connecting flow passage 49 (the left side of the second flow passage defining part or left side of the second flow passage) along the width direction (X-axis direction) of the first chamber, and the second outlet 433 may include a plurality of holes disposed on the right side of the connecting flow passage 49 (the right side of the second flow passage defining part or the right side of the second flow passage).

As shown in FIG. 12, the second flow passage 436 branches from the first flow passage 431 and is configured to guide water in the first flow passage 431 into the second chamber 42.

As shown in FIG. 13, the second flow passage 436 may include a second flow passage outlet 437 formed through the second flow passage body 43*b* in a penetrating manner, a first branch flow passage 436*a* provided in the second flow passage body 43*b* to guide water in the first flow passage 431 into the second chamber 42, and a second branch flow passage 436*b* provided in the second flow passage body 43*b* to connect the first branch flow passage 436*a* to the second flow passage outlet 437.

The second flow passage outlet 437 may be formed through the second flow passage body 43*b* in a penetrating manner and may include a hole allowing the upper space of the second chamber 42 to communicate with the lower space therethrough.

The first branch flow passage 436*a* and the second branch flow passage 436*b* may be divided by a guide (or first guide) 438 provided to the second flow passage body 43*b*.

The first guide 438 may include a wall protruding from the second flow passage body 43*b* toward the top surface of the second chamber 42. In this case, the first guide 438 may include a wall extending from the first flow passage 41 toward the inside of the second chamber 42 (extending along along the insertion direction of the drawer or the −Z-axis direction).

The second branch flow passage 436*b* may be arranged to connect the first branch flow passage 436*a* and the first flow passage 41 such that water that has entered the second flow passage 436 but is not discharged from the second chamber 42 through the second flow passage outlet 437 may be re-supplied to the first branch flow passage 41.

In this case, the second flow passage 436 may further include a guide (second guide) 439 positioned between the first flow passage and the second flow passage outlet to form a boundary between the first flow passage 41 and the second branch flow passage 436*b*.

The second guide 439 is a means to guide water introduced into the second branch flow passage 436*b* to the second flow passage outlet 437. The second guide 439 may include a wall protruding from the second flow passage body 43*b* towards the top surface of the second chamber 42 and extending along the edge of the first flow passage 41.

The upper end (free end) of the second guide 439 may be arranged not to contact the top surface of the second chamber 42 such that water that is not discharged into the second chamber 42 through the second flow passage outlet 437 may be supplied to the first flow passage 41. In other words, the upper end (free end) of the second guide 439 may be positioned between the bottom surface of the first flow passage 41 and the upper end of the first guide 438.

The bottom surface of the first flow passage 431 may be positioned at a higher point than the bottom surface of the second flow passage 436 to facilitate supply of water from the first flow passage 431 into the second flow passage 436.

FIG. 14 illustrates an example case where the bottom surface of the first flow passage 431 is positioned at a higher point than the bottom surface of the first branch flow passage 436*a*, and the bottom surface of the first branch flow passage 436*a* is positioned at a higher point than the bottom surface of the second branch flow passage 436*b*.

To minimize residual water inside the second flow passage 436 and to guide water inside the second flow passage 436 to the second flow passage outlet 437, the second branch flow passage 436*b* may be provided with a slope inclined down toward the second flow passage outlet 437.

When the pumps 6 and 7 operate, the detergent stored in the drawer 5 will be supplied to the second chamber 42 through the first supply pipe 421 and the second supply pipe 422. Also, when water is supplied to the second flow passage 436, the detergent in the second chamber 42 will move to the first chamber 41 through the connecting flow passage 49.

When the edge of the second flow passage body 43*b* is disposed not to contact the inner surface of the second chamber 42, a portion of the water in the first flow passage 436*a* will move to the second flow passage outlet 437 through the second flow passage 436*b* (as indicated by F1), and the other portion will move to the bottom surface of the second chamber 42 (as indicated by F2). Thus, the detergent supply device D may minimize the residual detergent inside the second chamber 42.

As shown in FIG. 15, water in the first flow passage 431 is supplied into the first chamber 41 through the first outlet 432 and the second outlet 433. As described above, the first outlet 432 is provided with a plurality of discharge flow passages disposed on the left side of the connecting flow passage 49 along the width direction (x-axis direction) of the first chamber, and the second outlet 433 is provided with a plurality of discharge flow passages disposed on the right side of the connecting flow passage 49 along the width direction (x-axis direction) of the first chamber.

By disposing the first outlet 432 and the second outlet 433 along the width direction of the first chamber with the connecting flow passage 49 disposed therebetween, water may be supplied evenly over the entire bottom surface of the first chamber 41. Thus, the detergent supply device D may minimize the possibility of residual detergent inside the first chamber 41.

Further, the first outlet 432 and the second outlet 433 may be arranged to discharge the water in the first flow passage 431 to the rear surface 415 of the first chamber. This is intended to minimize residual detergent on the rear surface 415 of the first chamber.

When water is supplied to the first chamber 41 through the first outlet 432 and the second outlet 433, the detergent introduced into the first chamber 41 through the connecting flow passage 49 will move to the chamber discharge portion 416.

The chamber discharge portion 416 may be provided on the bottom surface 412 of the first chamber 41. FIG. 16 illustrates an example case where the bottom surface 412 of the first chamber is bent in a direction away from the bottom surface of the drawer 5 to form the chamber discharge portion 416.

When the chamber discharge portion 416 is diposed above the tub inlet 24, water and detergent discharged from the chamber discharge portion 416 will be supplied directly into the tub body 21 through the tub inlet 24.

As described above, the detergent stored in the drawer 5 may be supplied to the second chamber 42 by the pumps 6 and 7. FIG. 17 illustrates an example case where the pumps include a first pump 6 and a second pump 7 separated by the second chamber 42 arranged therebetween.

As shown in FIG. 18, the first pump 6 may be configured to be connected to the first discharge valve 515 to move detergent from the first storage portion 511 to the second chamber 42 when the drawer 5 is inserted into the first chamber 41. The second pump 7 may be configured to be connected to the second discharge valve 517 to move detergent from the second storage portion 512 to the second chamber 42 when the drawer 5 is inserted into the first chamber 41.

Considering the case of assembly and case of repair of the pumps 6 and 7, the first pump 6 and the second pump 7 may be fixed to the rear surface 415 of the housing so as to be spaced apart from each other across the second chamber 42.

The first pump 6 and the second pump 7 may be formed in various structures as long as the functions described above can be implemented. For example, FIG. 18 illustrates a case where both the pumps 6 and 7 are piston pumps.

The first pump 6 according to this embodiment may include a first pump case 61 fixed to the rear surface 416 of the housing to provide a path for movement of the detergent, a first piston 63 configured to generate the power required to move the detergent, and a first piston case 62 fixed to the first pump case to provide a path for movement of the first piston 63.

A first inflow chamber 611 and a first discharge chamber 614 separated by a first chamber partition 615 are provided in the first pump case 61. A first chamber communication hole 615*a* is formed in the first chamber partition 615, and thus the first inflow chamber 611 and the first discharge chamber 614 are connected to each other therethrough.

The first inflow chamber 611 may be connected to the first storage portion 511 through the first connection pipe 612, and the first discharge chamber 614 may be connected to the first supply pipe 421 through the first discharge pipe 613.

The first connection pipe 612 may include a pipe having one end connected to the first inflow chamber 611 and an opposite end positioned inside the first chamber 41. The opposite end of the first connection pipe 612 may open the first discharge valve 515 when the drawer body 51 is inserted into the first chamber 41.

The first connection pipe 612 may be provided with a first inlet 612*a* to allow detergent in the first storage portion 511 to flow into the first connection pipe 612 when the first discharge valve 515 is opened by the first connection pipe 612.

The first inlet 612*a* may be provided in an area of the outer circumferential surface of the first connection tube 612 that faces the bottom surface of the first storage portion 511. By arranging the first inflow chamber 612*a* to face the bottom surface of the first storage portion 511, the residual detergent inside the first storage portion 511 may be minimized, thereby minimizing the number of times the first storage portion 511 is refilled with detergent.

A first inflow chamber valve 616 is provided in the first inflow chamber 611, and a first discharge chamber valve 617 is provided in the first discharge chamber 614.

The first inflow chamber valve 616 may be configured as a check valve that controls the opening and closing of the first inlet 612*a* or the opening and closing of the first connection pipe 612. FIG. 18 illustrates an example case where the first inflow chamber valve 616 is configured to control the opening and closing of the first connection pipe 612. The first inflow chamber valve 616 allows detergent to flow into the first inflow chamber 611 but blocks detergent from being discharged through the first connection pipe 612.

The first discharge chamber valve 617 is a means to open and close a first chamber communication hole 615*a* provided in the first chamber partition 615. It may be configured as a check valve that allows detergent to flow into the first chamber communication hole 615*a* but blocks detergent from being discharged from the first chamber communication hole 615*a*.

The first piston case 62 has a first piston chamber 621 that provides a path for movement of the first piston 63, the first piston chamber 621 being connected to the first inflow chamber 611 through the first case communication hole 622.

The first piston 63 is caused to reciprocate inside the first piston chamber 621 by a first piston drive. FIG. 18 illustrates an example case where the first piston drive includes a motor, a first gear 632 rotated by the motor, and a first rod 631 connecting the first gear 632 and the first piston 63.

The second pump 7 may have the same structure as the first pump 6 described above. In other words, the second pump 7 may include a second pump case 71 fixed to the rear surface 416 of the housing to provide a path for movement of the detergent, a second piston 73 configured to generate power for movement of the detergent, and a second piston case 72 fixed to the second pump case to provide a path for movement of the second piston 73.

A second inflow chamber 711 and a second discharge chamber 714 separated by a second chamber partition 715 are provided in the second pump case 71. A chamber second communication hole 715*a* is formed in the chamber second partition 715.

The second inflow chamber 711 may be connected to the second storage portion 512 through the second connection pipe 712, and the second discharge chamber 714 may be connected to the second supply pipe 42 through the second discharge pipe 713.

The second connection pipe 712 may include a pipe having one end connected to the second inflow chamber 711 and an opposite end positioned inside the first chamber 41. The opposite end of the second connection pipe 712 may open the second discharge valve 517 when the drawer body 51 is inserted into the first chamber 41.

The second connection pipe 712 may be provided with a second inlet 712*a* to allow detergent in the second storage portion 512 to flow into the second connection pipe 712 when the second discharge valve 517 is opened by the second connection pipe 712.

To minimize the residual detergent inside the second storage portion 512, the second inlet 712*a* may be provided in an area of the outer circumferential surface of the second connection tube 712 that faces the bottom surface of the second storage portion 512.

The second inflow chamber 711 is provided with a second inflow chamber valve 616, and the second discharge chamber 714 is provided with a second discharge chamber valve 717.

The second inflow chamber valve 716 is a means to allow detergent to flow into the second inflow chamber 711 but block detergent from being discharged through the second connection pipe 712. The second inflow chamber valve 716 may be configured as a check valve that controls the opening and closing of the second inlet 712*a* or the opening and closing of the second connection pipe 712.

The second discharge chamber valve 717 may be configured as a means to open and close a second chamber communication hole 715*a* provided in the second chamber partition 715. It may be configured as a check valve that allows detergent to flow into the second chamber communication hole 715*a* but blocks detergent from being discharged from the chamber second vent hole 715*a*.

The second piston case 72 has a second piston chamber 721 that provides a path for movement of the second piston 73, the second piston chamber 721 being connected to the second inflow chamber 711 through a second case passage 722.

The second piston 73 is caused to reciprocate inside the second piston chamber 721 by a second piston drive. FIG. 18 illustrates an example case where the second piston drive includes a motor, a second gear 732 rotated by the motor, and a second rod 731 connecting the second gear 732 and the second piston 73.

The first discharge valve 515 provided in the drawer 5 may include a first valve body 515*a* formed through the rear surface of the first storage portion 511, a first storage portion outlet (a first valve flow passage) 514 provided in the first valve body to provide a space into which the first connection pipe 612 is inserted, a first valve supply inlet 515*b* formed through the first valve body to introduce detergent from the first storage portion 511 into the first storage portion outlet 514, and a first opening/closing body 515*c* configured to reciprocate within the first storage portion outlet 514 to open and close the first valve supply inlet 515*b*.

Thus, when the first opening/closing body 515*c* opens the first valve supply inlet 515*b*, detergent in the first storage portion 511 may move to the first storage portion outlet 514 through the first valve supply inlet 515*b*, and detergent in the first storage portion outlet 514 may move to the first inflow chamber 611 of the first pump through the first inlet 612*a*.

The second discharge valve 517 may include a second valve body 517*a* formed through the rear surface of the second storage portion 512, a second storage portion outlet (a second valve flow passage) 516 provided in the second valve body to provide a space into which the second connection pipe 712 is inserted, a second valve supply inlet 517*b* formed through the second valve body to introduce detergent from the second storage portion 512 into the second storage portion outlet 516, and a second opening/closing body 517*c* configured to reciprocate within the second storage portion outlet 516 to open and close the second valve supply inlet 517*b*.

Thus, when the second opening/closing body 517*c* opens the second valve supply inlet 517*b*, detergent in the second storage portion 512 may move to the second storage portion outlet 516 through the second valve supply inlet 517*b*, and detergent in the second storage portion outlet 516 may move to the second inflow chamber 711 of the second pump through the second inlet 712*a*.

As described above, the detergent supply device D may minimize the amount of detergent remaining in the first storage portion 511 and the second storage portion 512 based on the location of the first inlet 612*a* and the location of the second inlet 712*a*. To further reduce the amount of detergent remaining in each of the storage portions 511 and 512, the first connection pipe 612 and the second connection pipe 712 may be arranged to be located at a lower point H than the second chamber 42 (see FIG. 14).

The detergent supply device D may further include a supply sensing part 81 configured to determine whether detergent stored in the drawer 5 is being supplied to the tub body 21.

As shown in FIG. 15, the supply sensing part 81 may include two electrodes 811, 812 fixed to the housing 4 and positioned in the connecting flow passage 49. The first electrode 811 and the second electrode 812 of the supply sensing part constitute a current detection circuit (a circuit capable of determining whether current is flowing). The first electrode 811 and the second electrode 812 may be disposed inside the connecting flow passage 49 such that they are spaced apart along the width direction (X-axis direction) of the connecting flow passage.

When water or detergent is supplied to the second chamber 42, the fluid inside the second chamber 42 moves to the first chamber 41 through the connecting flow passage 49. As the water or detergent moves along the connecting flow passage 49, the two electrodes 811 and 812 will be connected by the fluid moving along the connecting flow passage 49.

The electrical resistance value when the two electrodes 811 and 812 are connected by water will be different from the electrical resistance value when the two electrodes 811 and 812 are connected by a mixture of water and detergent. Therefore, the controller (not shown) may determine whether detergent is being supplied to the tub body 21 by monitoring the current value in the current detection circuit.

As shown in FIG. 19, the detergent supply device D may further include a mounting sensing part 83 configured to determine whether the drawer 5 is mounted in the housing 4.

The mounting sensing part 83 may include a sensor 832 fixed to the housing 4 and configured to generate an electrical signal when the drawer 5 is inserted into the first chamber 41, and a connection terminal 836 configured to supply power to the sensor 832, or transmit the signal generated by the sensor to the outside.

The sensor 832 may be configured in various structures as long as it is capable of sensing the position of the body 51 of the drawer. FIG. 19 illustrates an example in which the sensor 832 is configured as a device to generate an electrical signal when the sensor 832 comes into contact with a protrusion 831 provided on the rear surface of the body 51 or when the contact is broken.

The protrusion 831 may include a bar protruding from the rear surface of the body 51 in the direction in which the body is inserted (−Z-axis direction). When the mounting sensing part 83 includes the protrusion 831 and the sensor 832, the rear surface 415 of the housing may further include a protrusion through-hole 45 through which the protrusion 831 is arranged, and a mounting portion 46 providing a mounting space for the sensor 832.

The sensor 832 may include a sensor case 833 fixed to the mounting portion 46, a switch 837 arranged in the sensor case 833 to contact the connection terminal 836, and a contact portion 834 arranged through one surface of the sensor case 833 in a penetrating manner to control opening and closing of the switch 837.

The contact portion 834 may be a bar having one end exposed to the outside of the sensor case 833 and an opposite end positioned inside the sensor case 833. The contact portion 834 may be arranged spaced apart from the switch 837 while the one end of the contact portion 834 is inserted into the protruding through-hole 45, and the opposite end of the contact portion 834 is positioned inside the sensor case 833.

When the drawer 5 is inserted into the first chamber 41, the protrusion 831 is inserted into the protrusion through-hole 45, pushing the contact portion 834 toward the switch 837. When the contact portion 834 pushes the switch 837, the switch 837 closes the circuit including the connection terminal 836, and the control (not shown) may determine that the drawer 5 is inserted into the first chamber 41 based on a signal generated or transmitted when the circuit including the connection terminal is closed.

When the drawer 5 is withdrawn from the first chamber 41, the switch 837 will open the circuit including the connection terminal 836, and thus the controller (not shown) may determine that the drawer 5 has been withdrawn from the first chamber 41.

In the mounting sensing part 83 of the above-described structure, the possibility of water or detergent flowing into the connection terminal 836 cannot be excluded because the sensor 832 is fixed to the rear surface 415 of the housing, and the connection terminal 836 is fixed to the sensor 832 and exposed to the outside.

To eliminate the above-mentioned risk, the detergent supply device D may further include a sensing part cover 9 that prevents water from flowing into the connection terminal 836. FIG. 19 illustrates an example case where the housing 4 is provided with the sensing part cover 9.

As shown in FIG. 19, the sensing part cover 9 may include a fixed body 91 fixed to the top surface 411 of the housing, and a board-shaped extension body 92 extending from the fixed body 91 and positioned over the connection terminal 836.

In contrast, when the connection terminal 836 is positioned at a lower point than the top surface 411 of the housing, the extension body 92 may be provided as a board extending from the top surface 411 of the housing to the top of the connector 836, or a board extending from the rear surface 415 of the housing to the top of the collection terminal 836.

Since the extension body 92 may be shaped to cover the top surface of the connector 836, the sensing part cover 9 described above may reduce the risk of failure that may be caused by any water or foreign substances supplied to the collection terminal 836.

The extension body 92 may be inclined down (by A) toward the fixed body 91. This is intended to prevent water or foreign substances on the top surface of the extension body 92 from being retained on the top surface 411 of the housing to reduce the likelihood of water or foreign substances being supplied to the connection terminal 836.

In the case of a detergent supply device that secures the sensor 832 to the mounting portion 46 of the housing through a fastening portion 48 and the fastening hole 47, it may be inconvenient to secure or remove the sensor 832 to or from the mounting portion 46 if the sensing part cover 9 is arranged to cover the top surface of the sensor 832. The fastening portion 48 may include a bolt that passes through the fastening hole 47 and connects to the sensor case 833.

To eliminate the inconvenience described above, the extension body 92 may be provided with a through-hole (assembly hole) 921 formed through the extension body 92 in a penetrating manner so as to be positioned over the fastening hole 47.

As shown in FIG. 20, the assembly hole 921 may provide a path for movement of the fastening portion 48, and thus the detergent supply device D may facilitate assembly of the sensor 832 and the mounting portion 46 despite the presence of the sensing part cover 9.

The top surface of the extension body 92 may further include a drainage flow passage 922. The drainage flow passage 922 is a flow passage provided on the top surface of the extension body 92 to guide water or foreign substances to the outside of the extension body 92 The drainage flow passage 922 may be provided as a flow passage inclined down toward the fixed body 91.

When the assembly hole 921 is positioned inside the drainage flow passage 922, the edge of the assembly hole 921 may be provided with a barrier to prevent water or foreign substances from entering.

The above-described detergent supply device and laundry treatment apparatus are merely preferred embodiments, and therefore the scope of the present disclosure is not limited to the above-described embodiments.

As is apparent from the above description, the present disclosure has effects as follows.

The present disclosure may provide a detergent supply device capable of minimizing the issue of residual detergent in a flow passage that guides the detergent to a tub, and a laundry treatment apparatus having the detergent supply device.

In addition, the present disclosure may provide a detergent supply device that is easy to maintain and a laundry treatment apparatus having the detergent supply device.

Further, a detergent supply device capable of increasing the durability of a mounting sensing part that detects whether a drawer is mounted, and a laundry treatment apparatus having the detergent supply device.

It will be apparent to those skilled in the art that various modifications and variations can be made in the present disclosure without departing from the spirit and scope of the invention. Thus, it is intended that the present disclosure cover the modifications and variations of this invention provided they come within the scope of the appended claims and their equivalents.

What is claimed is:

1. A detergent supply device comprising:

a drawer comprising:

a body having a first storage portion and a second storage portion configured to store a detergent;

a first discharge valve configured to discharge a detergent from the first storage portion; and a second discharge valve configured to discharge a detergent from the second storage portion;

a housing comprising:

a first chamber allowing the body to be withdrawably accommodated therein;

a second chamber defining a space separated from the first chamber and arranged to communicate with the first chamber through a connecting flow passage; and a chamber discharge portion configured to discharge a material inside the first chamber to an outside of the first chamber;

a first flow passage providing a path for movement of water along a direction orthogonal to a withdrawal direction of the body to supply water to the first chamber;

a second flow passage branching from the first flow passage to supply water to the second chamber;

a first pump configured to be connected to the first discharge valve to supply the detergent from the first storage portion to the second chamber when the body is inserted into the first chamber; and a second pump configured to be connected to the second discharge valve to supply the detergent from the second storage portion to the second chamber when the body is inserted into the first chamber, wherein the first pump and the second pump are fixed to the housing so as to be positioned at points spaced apart from each other across the second chamber.

2. The detergent supply device of claim 1, further comprising:

a first connection pipe configured to open the first discharge valve to introduce the detergent inside the first storage portion into the first pump; and a second connection pipe configured to open the second discharge valve to introduce the detergent inside the second storage portion into the second pump, wherein the first connection pipe and the second connection pipe are positioned at a lower point than the second chamber.

3. The detergent supply device of claim 2, further comprising:

a first inlet formed through the first connection pipe in a penetrating manner to introduce the detergent into the first connection pipe, the first inlet being arranged in an area of an outer circumferential surface of the first connection pipe facing a bottom surface of the first storage portion; and a second inlet formed through the second connection pipe in a penetrating manner to introduce the detergent into the second connection pipe, the second inlet being arranged in an area of an outer circumferential surface of the second connection pipe facing a bottom surface of the second storage portion.

4. The detergent supply device of claim 3, wherein the second flow passage is configured to re-supply water not supplied to the second chamber to the first flow passage.

5. The detergent supply device of claim 4, further comprising:

a plurality of first outlets configured to discharge water inside the first flow passage to the first chamber, the first outlets being positioned on one side of the connecting flow passage; and a plurality of second outlets configured to discharge the water inside the first flow passage into the first chamber, the second outlets being positioned on an opposite side of the connecting flow passage.

6. The detergent supply device of claim 3, further comprising:

a first flow passage body fixed to the housing, the first flow passage body defining a top surface of the first chamber and providing a space to define the first flow passage; and a second flow passage body fixed to the first flow passage body, the second flow passage body dividing an inside of the second chamber into an upper space and a lower space and providing a space to define the second flow passage.

7. The detergent supply device of claim 6, wherein a bottom surface of the first flow passage is positioned at a higher point than a bottom surface of the second flow passage.

8. The detergent supply device of claim 6, wherein the second flow passage comprises:

a second flow passage outlet formed through the second flow passage body to connect the upper space and the lower space;

a first branch flow passage provided in the second flow passage body and connected to the first flow passage, the first branch flow passage extending from the first flow passage toward the second chamber; and a second branch flow passage provided in the second flow passage body to connect the first branch flow passage and the second flow passage outlet, the second branch flow passage extending toward the first flow passage.

9. The detergent supply device of claim 8, wherein a bottom surface of the first flow passage is positioned at a higher point than a bottom surface of the first branch flow passage, and wherein the bottom surface of the first branch flow passage is positioned at a higher point than the second flow passage outlet.

10. The detergent supply device of claim 8, wherein the second branch flow passage is inclined down toward the second flow passage outlet.

11. The detergent supply device of claim 8, wherein the second branch flow passage connects the first branch flow passage to the second chamber to allow water not supplied to the second chamber through the second flow passage outlet to be re-supplied to the first flow passage.

12. The detergent supply device of claim 11, further comprising:

a first guide provided in the second flow passage body to define the first branch flow passage and the second branch flow passage; and a second guide positioned between the first flow passage and the second flow passage outlet to form a boundary between the first flow passage and the second branch flow passage.

13. The detergent supply device of claim 12, wherein the second guide comprises a wall protruding from a bottom surface of the second branch flow passage to a point higher than a bottom surface of the first flow passage.

14. The detergent supply device of claim 12, wherein the second guide comprises a wall protruding from the second branch flow passage, and wherein a free end of the wall is positioned between a bottom surface of the first flow passage and an upper end of the first guide.

15. A laundry treatment apparatus comprising:

a tub comprising:

a tub body providing a space to store water; and a tub inlet formed through one surface side of the tub body in a penetrating manner;

a drum rotatably disposed in the tub to store laundry;

a drawer comprising:

a body;

a first storage portion and a second storage portion provided in the body to provide a space to store a detergent;

a first discharge valve configured to discharge a detergent from the first storage portion; and a second discharge valve configured to discharge a detergent from the second storage portion;

a housing positioned at a higher point than the tub inlet, the housing comprising:

a first chamber allowing the body to be withdrawably accommodated therein;

a second chamber defining a space separated from the first chamber and arranged to communicate with the first chamber through a connecting flow passage; and a chamber discharge portion configured to discharge a material inside the first chamber to the tub inlet;

a first flow passage providing a path for movement of water along a direction (a width direction of the first chamber) orthogonal to a withdrawal direction of the body to supply water to the first chamber;

a second flow passage branching from the first flow passage to supply water to the second chamber;

a first pump configured to be connected to the first discharge valve to supply the detergent from the first storage portion to the second chamber when the body is inserted into the first chamber; and a second pump configured to be connected to the second discharge valve to supply the detergent from the second storage portion to the second chamber when the body is inserted into the first chamber, wherein the first pump and the second pump are fixed to the housing so as to be positioned at points spaced apart from each other across the second chamber.

16. The laundry treatment apparatus of claim 15, wherein the first pump comprises:

a first pump case fixed to the housing;

a first inflow chamber and a first discharge chamber provided within the first pump case, the first inflow chamber and the first discharge chamber being separated by a first chamber partition;

a chamber communication hole formed through the first chamber partition to connect the first inflow chamber and the first discharge chamber;

a first connection pipe arranged through the housing to have one end connected to the first inflow chamber and an opposite end disposed in the first chamber, the first connection pipe opening the first discharge valve when the body is inserted into the first chamber;

a first discharge pipe arranged to discharge the detergent inside the first discharge chamber into the second chamber;

a first piston chamber connected to the first inflow chamber through a first case communication hole;

a first piston disposed to reciprocate in the first piston chamber;

a first inflow chamber valve disposed in the first inflow chamber to open and close the first connection pipe; and a first discharge chamber valve disposed in the first discharge chamber to open and close the chamber communication hole.

17. The laundry treatment apparatus of claim 15, wherein the second pump comprises:

a second pump case fixed to the housing;

a second inflow chamber and a second discharge chamber provided within the second pump case, the second inflow chamber and the second discharge chamber being separated by a second chamber partition;

a chamber communication hole formed through the second chamber partition to connect the second inflow chamber and the second discharge chamber;

a second connection pipe arranged through the housing to have one end connected to the second inflow chamber and an opposite end disposed in the second chamber, the second connection pipe opening the second discharge valve when the body is inserted into the second chamber;

a second discharge pipe arranged to discharge the detergent inside the second discharge chamber into the second chamber;

a second piston chamber connected to the second inflow chamber through a second case communication hole;

a second piston disposed to reciprocate in the second piston chamber;

a second inflow chamber valve disposed in the second inflow chamber to open and close the second connection pipe; and a second discharge chamber valve disposed in the second discharge chamber to open and close the chamber communication hole.

18. The laundry treatment apparatus of claim 15, further comprising:

a first connection pipe configured to open the first discharge valve to introduce the detergent inside the first storage portion into the first pump; and a second connection pipe configured to open the second discharge valve to introduce the detergent inside the second storage portion into the second pump, wherein the first connection pipe and the second connection pipe are disposed at a lower point than the second chamber.

19. The laundry treatment apparatus of claim 18, further comprising:

a first inlet formed through the first connection pipe in a penetrating manner to introduce the detergent into the first connection pipe, the first inlet being provided in an area of an outer circumferential surface of the first connection pipe facing a bottom surface of the first storage portion; and a second inlet formed through the second connection pipe in a penetrating manner to introduce the detergent into the second connection pipe, the second inlet being provided in an area of an outer circumferential surface of the second connection pipe facing a bottom surface of the second storage portion.

20. The laundry treatment apparatus of claim 19, further comprising:

a first flow passage body fixed to the housing to define a top surface of the first chamber, the first flow passage body providing a space to define the first flow passage; and a second flow passage body fixed to the first flow passage body to divide an inside of the second chamber into an upper space and a lower space, the second flow passage providing a space to define the second flow passage.

* * * * *